US011624142B2

(12) United States Patent
Chae et al.

(10) Patent No.: US 11,624,142 B2
(45) Date of Patent: Apr. 11, 2023

(54) WASHING MACHINE

(71) Applicant: LG Electronics Inc., Seoul (KR)

(72) Inventors: Kyosoon Chae, Seoul (KR); Hyundong Kim, Seoul (KR); Sooyoung Oh, Seoul (KR); Jaeyong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 236 days.

(21) Appl. No.: 16/845,969

(22) Filed: Apr. 10, 2020

(65) Prior Publication Data

US 2020/0325619 A1 Oct. 15, 2020

(30) Foreign Application Priority Data

Apr. 12, 2019 (KR) ..... 10-2019-0042783
Apr. 12, 2019 (KR) ..... 10-2019-0042784

(51) Int. Cl.

| | |
|---|---|
| ***D06F 39/02*** | (2006.01) |
| *D06F 34/14* | (2020.01) |
| *D06F 39/08* | (2006.01) |
| *D06F 39/12* | (2006.01) |

(52) U.S. Cl.

CPC ..... *D06F 39/022* (2013.01); *D06F 34/14* (2020.02); *D06F 39/088* (2013.01); *D06F 39/12* (2013.01)

(58) Field of Classification Search

CPC ..... D06F 39/022; D06F 34/20; D06F 39/088; D06F 39/12; D06F 34/14

See application file for complete search history.

(56) References Cited

U.S. PATENT DOCUMENTS

| | | | | |
|---|---|---|---|---|
| 9,133,576 | B2 * | 9/2015 | Lee | D06F 33/37 |
| 2005/0097925 | A1 * | 5/2005 | Kim | D06F 39/028 68/17 R |
| 2005/0274156 | A1 * | 12/2005 | Yang | D06F 39/028 68/17 R |
| 2008/0028802 | A1 | 2/2008 | Jordan et al. | |

(Continued)

FOREIGN PATENT DOCUMENTS

| | | |
|---|---|---|
| CN | 205258897 | 5/2016 |
| DE | 19654090 | 3/1998 |

(Continued)

OTHER PUBLICATIONS

Extended European Search Report in European Application No. 20169342.1, dated Sep. 2, 2020, 6 pages.

(Continued)

*Primary Examiner* — Benjamin L Osterhout

(74) *Attorney, Agent, or Firm* — Fish & Richardson P.C.

(57) ABSTRACT

According to the present disclosure, a washing machine includes: a cabinet; a tub disposed in the cabinet and configured to receive water; a drum rotatably disposed in the tub and configured to receive laundry; a drawer configured to be inserted into and withdrawn out of the cabinet, the drawer being configured to contain detergent; a first passage (Continued)

connecting the drawer and the tub; a detergent supply device disposed at the cabinet, the detergent supply device being configured to contain detergent; and a second passage disposed between the detergent supply device and the tub or between the detergent supply device and the drawer, the second passage being configured to guide the detergent contained in the detergent supply device to the tub or the drawer.

15 Claims, 31 Drawing Sheets

(56) References Cited

U.S. PATENT DOCUMENTS

| | | | | |
|---|---|---|---|---|
| 2009/0288454 | A1* | 11/2009 | Lee | D06F 39/022 68/17 R |
| 2009/0293202 | A1* | 12/2009 | Bolduan | D06F 39/028 68/17 R |
| 2010/0115709 | A1* | 5/2010 | Kim | D06F 39/022 68/17 R |
| 2010/0161143 | A1 | 6/2010 | Smith et al. | |
| 2013/0036775 | A1 | 2/2013 | Brueckner et al. | |
| 2013/0042652 | A1* | 2/2013 | Brueckner | D06F 33/37 68/12.02 |
| 2014/0123403 | A1* | 5/2014 | Zattin | D06F 35/006 68/16 |
| 2014/0157835 | A1* | 6/2014 | Del Pos | D06F 39/007 68/17 R |

FOREIGN PATENT DOCUMENTS

| | | |
|---|---|---|
| DE | 102010027992 | 10/2011 |
| EP | 1995368 | 11/2008 |
| EP | 2521811 B1 | 3/2015 |
| JP | 2018011618 | 1/2018 |
| KR | 1019990074113 | 10/1999 |
| KR | 1020050098521 | 10/2005 |
| KR | 1020110099288 | 9/2011 |
| KR | 1020130062271 | 6/2013 |
| KR | 1020140114086 | 9/2014 |
| WO | WO2018133620 | 7/2018 |

OTHER PUBLICATIONS

PCT International Search Report in International Application No. PCT/KR2020/004939, dated Aug. 3, 2020, 3 pages.
Office Action in Australian Appln. No. 2020273103, dated Oct. 31, 2022, 3 pages.

* cited by examiner

WASHING MACHINE

CROSS-REFERENCE TO RELATED APPLICATIONS

The present application claims priority under 35 U.S.C. 119 and 35 U.S.C. 365 to Korean Patent Application No. 10-2019-0042783, filed on Apr. 12, 2019, and Korean Patent Application No. 10-2019-0042784, filed on Apr. 12, 2019, which are hereby incorporated by reference in their entirety.

TECHNICAL FIELD

The present disclosure generally relates to a washing machine, and more particularly, to a washing machine capable of automatically providing the washing machine with various detergents.

BACKGROUND

A washing machine is a device that can handle laundry through washing, dehydration and/or drying and the like. For example, the washing machine can be used to remove contamination of a laundry load by using water and detergents. In some cases, one or more types of detergents may be automatically provided according to the type of laundry being washed.

SUMMARY

One object of the present disclosure is to provide a washing machine capable of supplying detergent to a tub with making use of a dispenser as conventional manner in case of not employing an automatic detergent supply device, and on the other hand, of supplying detergent contained in the automatic detergent supply device to the tub with making use of connection with the tub in case of employing the automatic detergent supply device.

Another object of the present disclosure is to provide a washing machine capable of supplying detergent to a tub with making use of a dispenser as conventional manner in case of not employing an automatic detergent supply device, and on the other hand, capable of supplying detergent contained in the automatic detergent supply device via a connection with the dispenser as conventional manner to the tub with making use of detergent supply system of the dispenser in case of employing the automatic detergent supply device.

Another object of the present disclosure is to provide a washing machine capable of supplying detergent supplied from the automatic detergent supply device to the tub with making use of a device previously installed on a main washing machine.

Objects of the present disclosure should not be limited to the aforementioned objects and other unmentioned objects will be clearly understood by those skilled in the art from the following description.

According to one aspect of the subject matter disclosed in this application, a washing machine includes: a cabinet; a tub disposed in the cabinet and configured to receive water; a drum rotatably disposed in the tub and configured to receive laundry; a drawer configured to be inserted into and withdrawn out of the cabinet, the drawer being configured to contain detergent; a first passage connecting the drawer and the tub; a detergent supply device disposed at the cabinet, the detergent supply device being configured to contain detergent; and a second passage disposed between the detergent supply device and the tub or between the detergent supply device and the drawer, the second passage being configured to guide the detergent contained in the detergent supply device to the tub or the drawer.

Implementations according to this aspect may include one or more of the following features. For example, the second passage may include: a second external passage that connects the detergent supply device to the cabinet and that is configured to guide the detergent in the detergent supply device to the cabinet; and a second internal passage that is disposed inside the cabinet and that is configured to guide the detergent supplied through the second external passage to the drawer or the tub. The washing machine may further include a vent pipe connecting an inside of the tub to an outside of the cabinet, and the second internal passage may be connected to the vent pipe such that the detergent supplied through the second internal passage is supplied to the tub via the vent pipe. The vent pipe may be connected to an upper side of the tub and a rear surface of the cabinet. Additionally, the washing machine may include a vent pipe tub connector disposed at an upper side of the tub, where the vent pipe connector may be disposed perpendicular to a lower surface of the cabinet, and where the vent pipe may be connected to the vent pipe tub connector.

In some implementations, the second internal passage may be connected to the drawer such that the detergent guided through the second internal passage is supplied to the tub via the drawer. The washing machine may include a drawer housing that accommodates the drawer at a lower side thereof, and the detergent may be supplied into the drawer is supplied to the drawer housing. The drawer housing may be connected to the first passage such that the detergent supplied to the drawer housing is supplied via the first passage to the tub. In some cases, the washing machine may include a water supply passage that is connected to the drawer, where the water may be supplied to the tub with detergent through the water supply passage via the first passage.

In some cases, the second internal may be is connected to the first passage such that detergent guided through the second internal passage is supplied to the tub via the first passage. The washing machine may further include a cabinet connector disposed at a rear surface of the cabinet, the cabinet connector connecting the second external passage to the second internal passage. Additionally, the second external passage may include: a connecting hose; a first head disposed at an end of the connecting hose, the first head being connected to the detergent supply device; and a second head disposed at the other end of the connecting hose, where the second head may be connected to the cabinet connector. The washing machine may include a first water supply valve that is configured to control supplying of water to the drawer. The washing machine may include a second water supply valve that is configured to control supplying of water to the detergent supply device. In some cases, the second passage may be disposed between the detergent supply device and the tub, the second passage being configured to guide the detergent contained in the detergent supply device to the tub. In some cases, the second passage may be disposed between the detergent supply device and the drawer, the second passage being configured to guide the detergent contained in the detergent supply device to the drawer.

It should be understood that advantageous effects according to the present disclosure are not limited to the effects set forth above and other advantageous effects of the present disclosure will be apparent from the detailed description of the present disclosure.

Details of other implementations will be described in the detailed description with reference to the accompanying drawings.

BRIEF DESCRIPTION OF THE DRAWINGS

FIGS. 20A to 20D are schematic views showing a connector shown in FIG. 18, wherein FIG. 20A is a perspective view showing a cover connector, FIG. 20B is a lateral view showing the cover connector, FIG. 20C is a perspective view showing the cabinet connector, and FIG. 20D is a lateral view showing the cabinet connector.

DETAILED DESCRIPTION

Hereinafter, the present disclosure will be more specifically described with reference the accompanying drawings.

Figure 1:
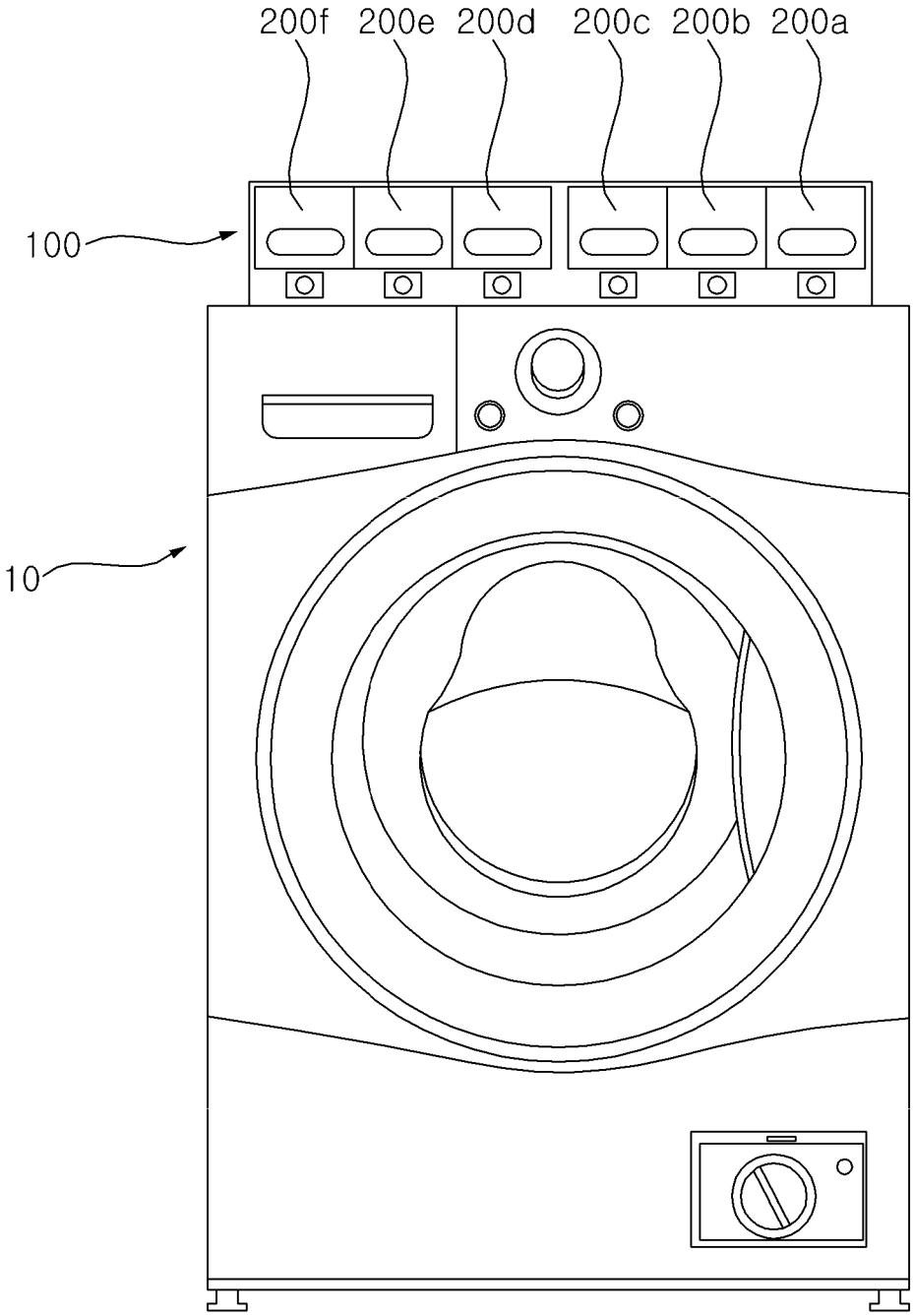
FIG. 1 is a schematic view of a front surface of an example washing machine according to an exemplary implementation of the present disclosure.
Figure 2:
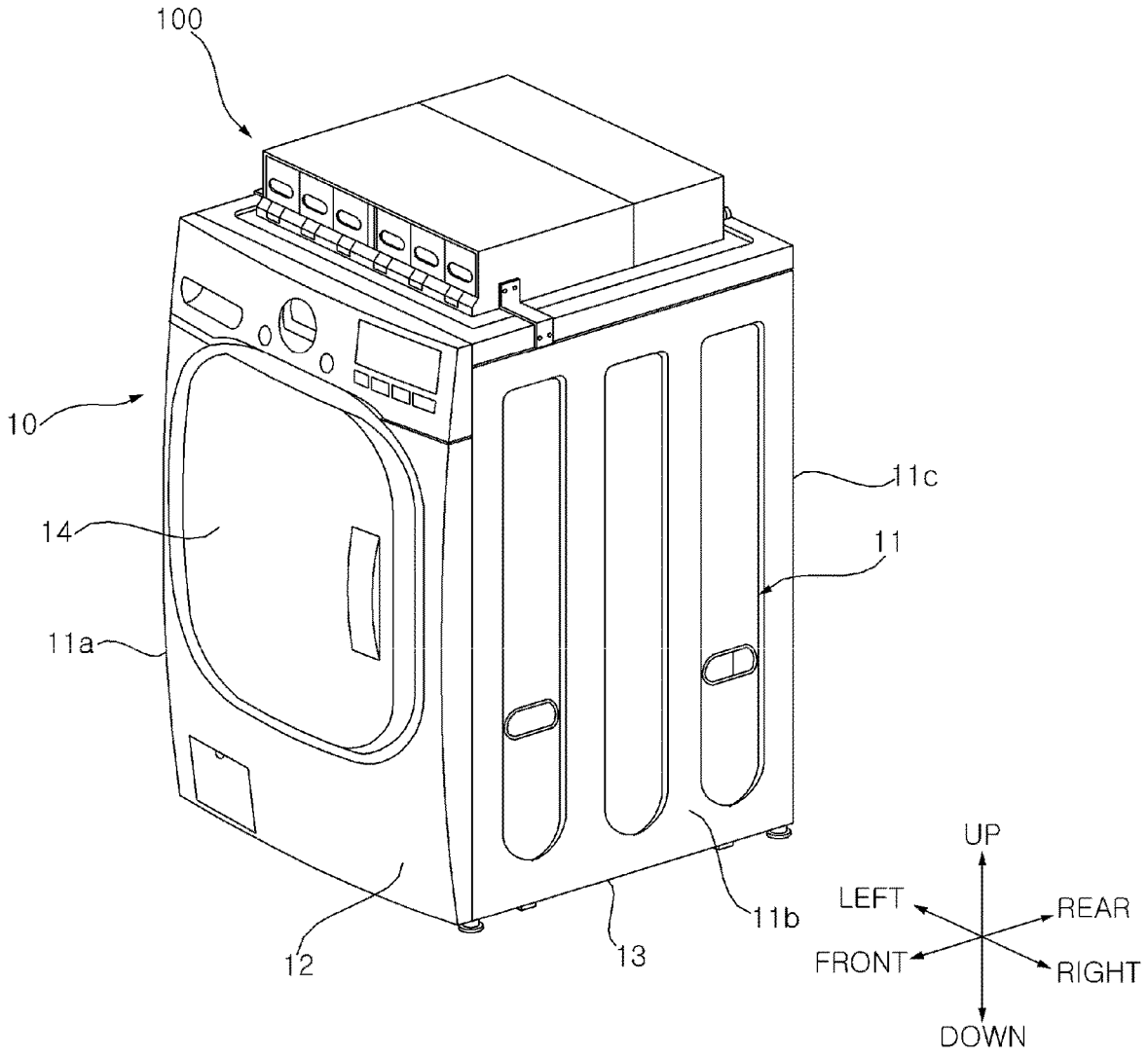
FIG. 2 is a perspective view of the washing machine shown in FIG. 1
Figure 3:
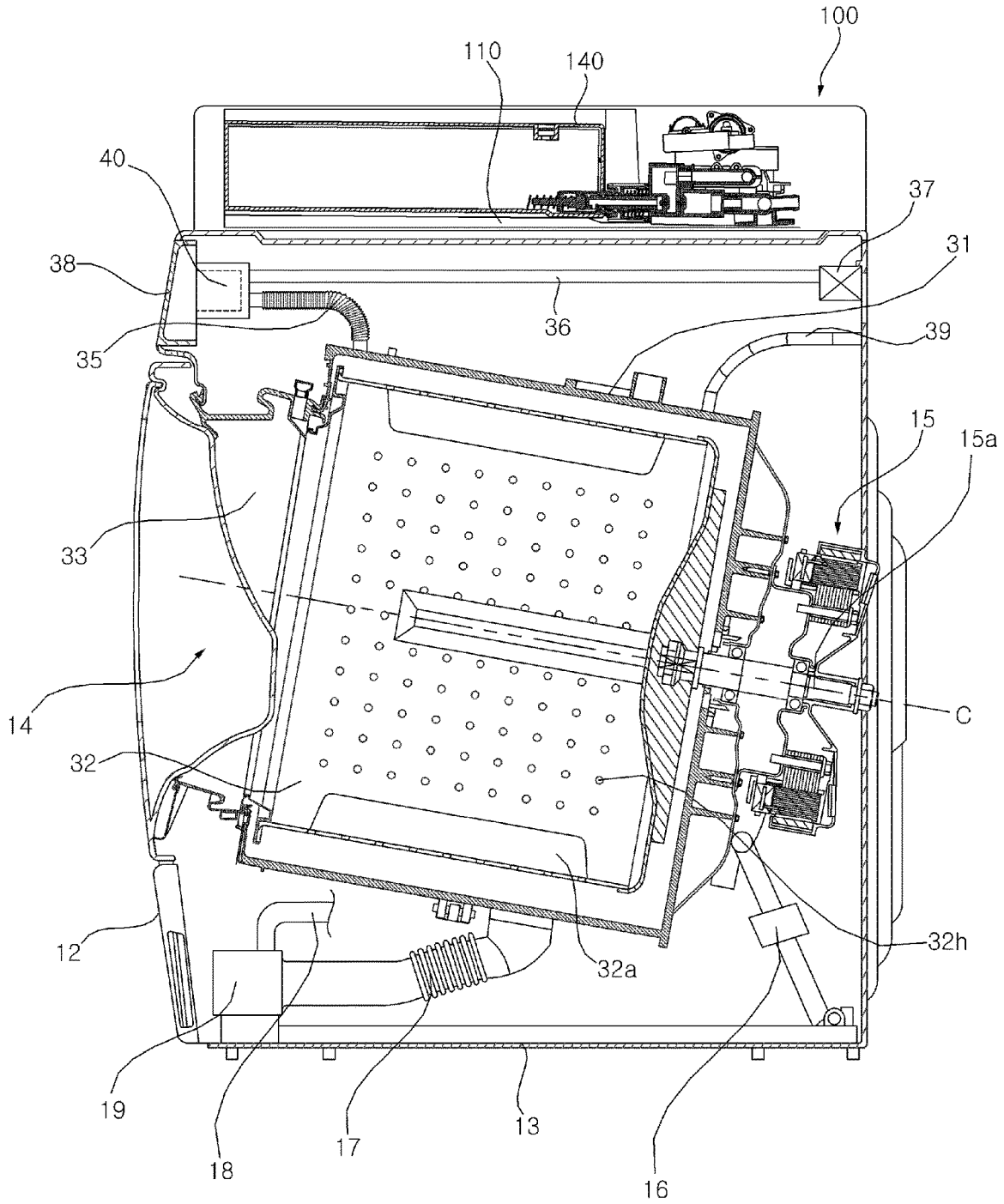
FIG. 3 is a lateral cross-sectional view showing the washing machine shown in FIG. 1.
Figure 4:
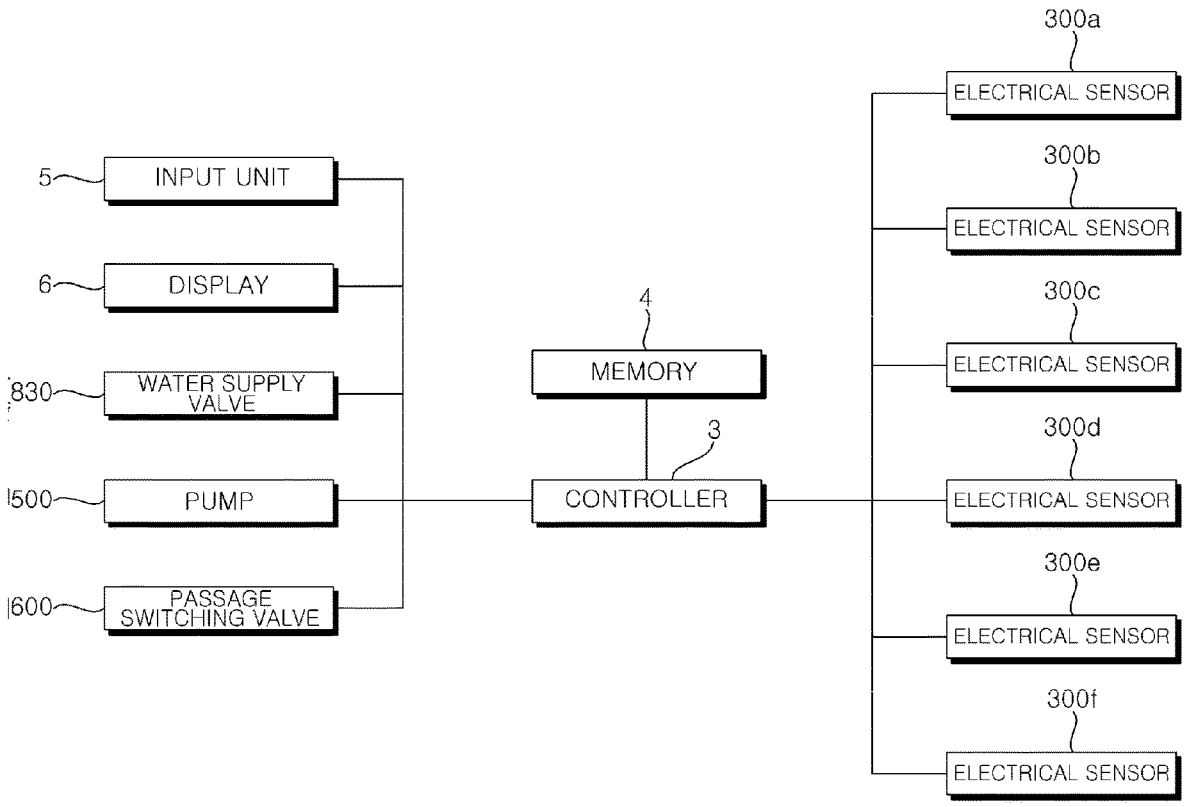
FIG. 4 is a block diagram showing a controller of the washing machine according to an exemplary implementation of the present disclosure.
Figure 5:
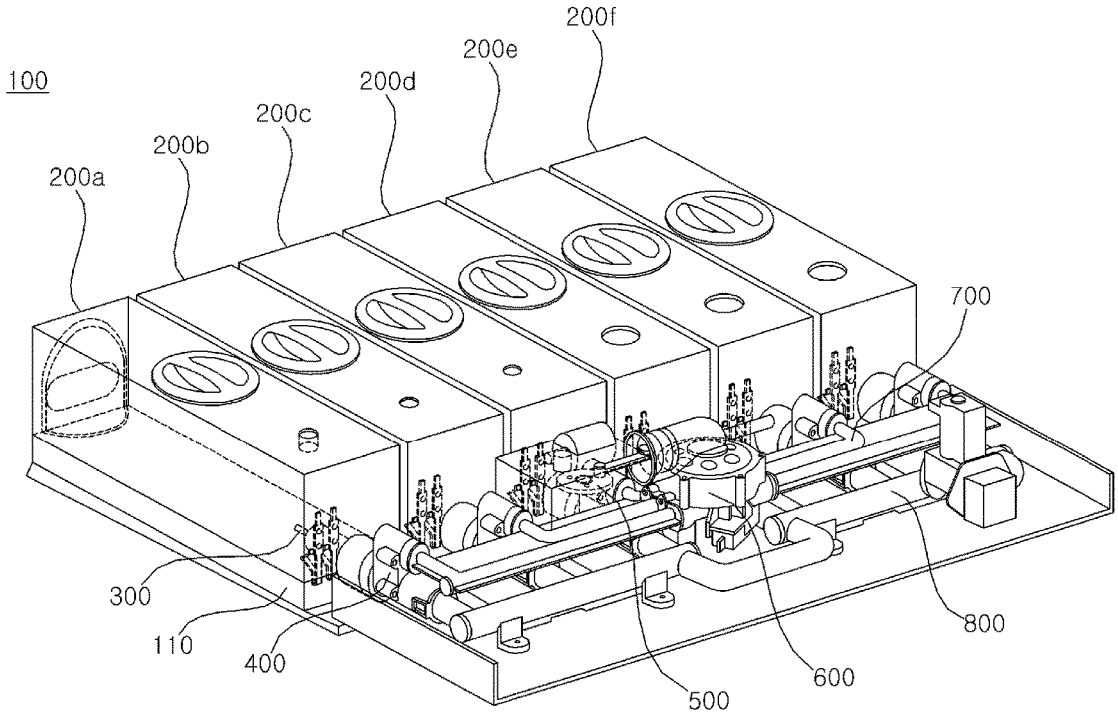
FIG. 5 is a schematic view showing an example detergent supply device shown in FIG. 1.
Figure 6:
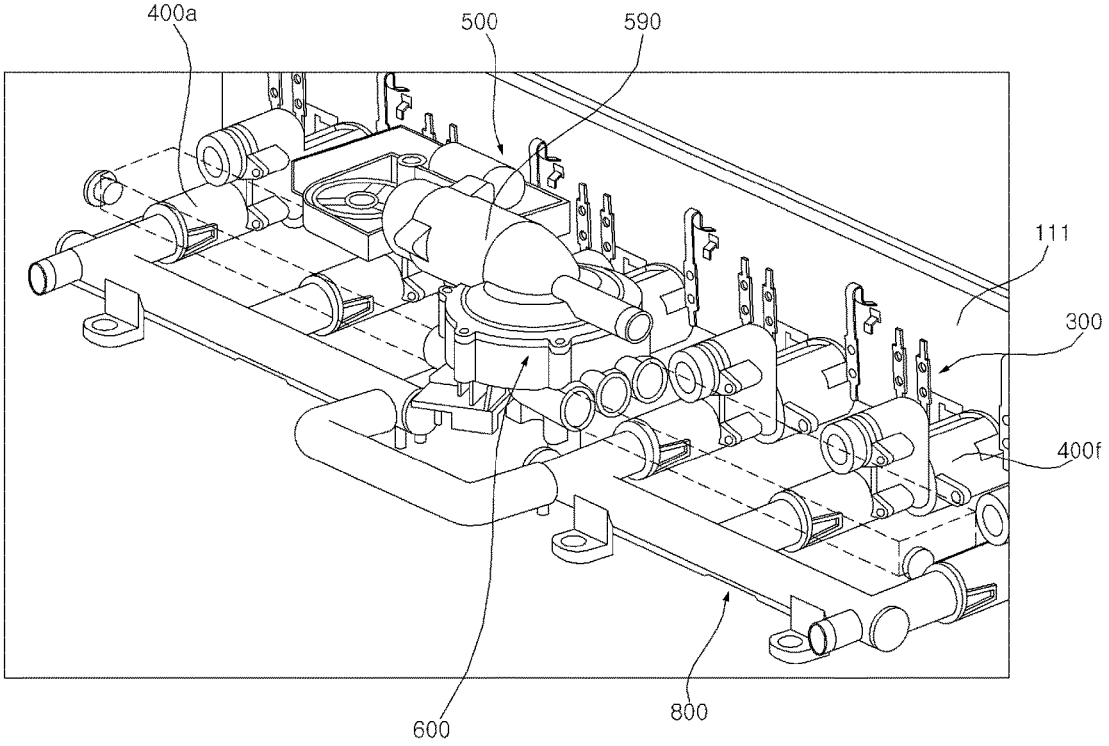
FIG. 6 is a schematic view showing a rear side of the detergent supply device shown in FIG. 5.
Figure 7:
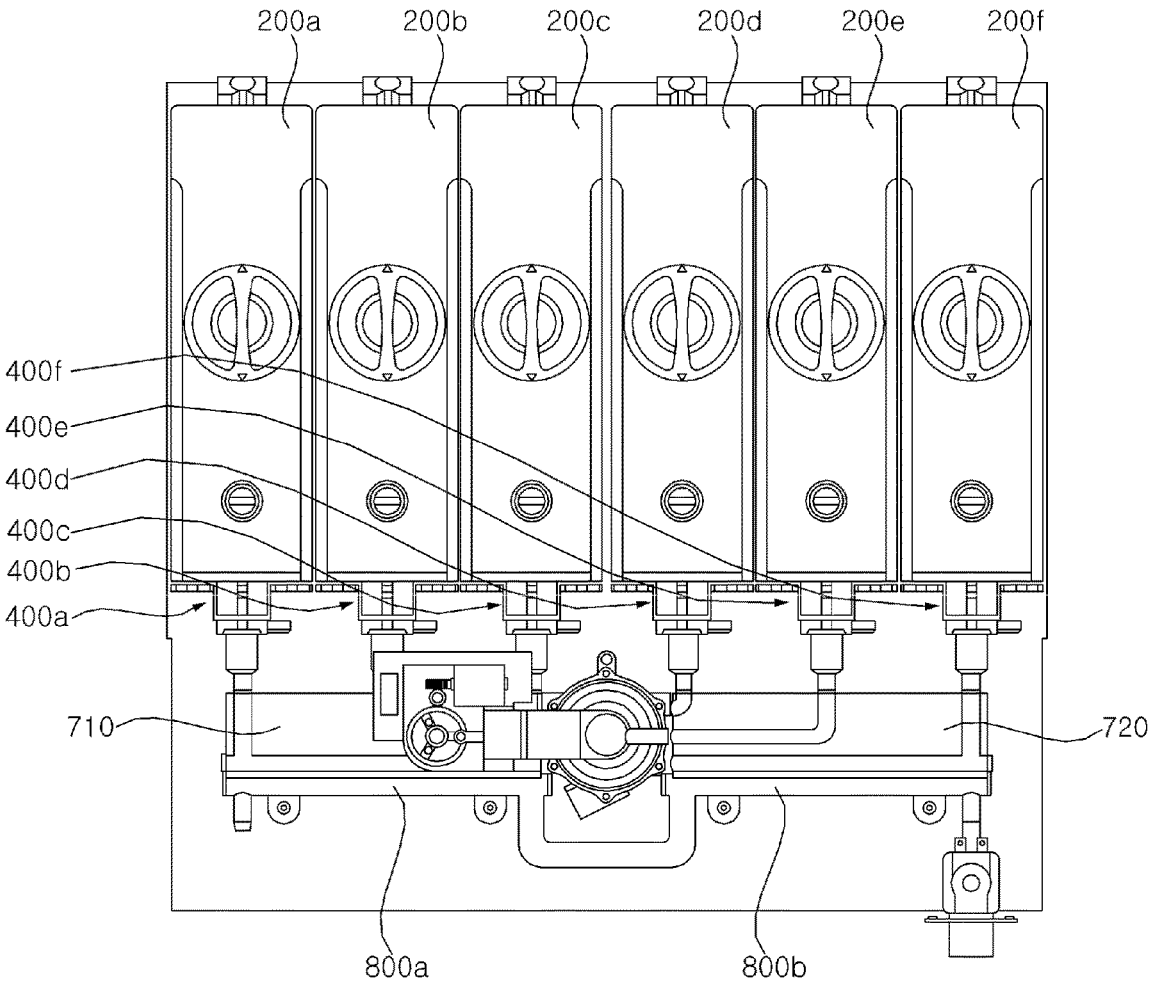
FIG. 7 is a schematic view showing the detergent supply device viewed from above.
Figure 8:
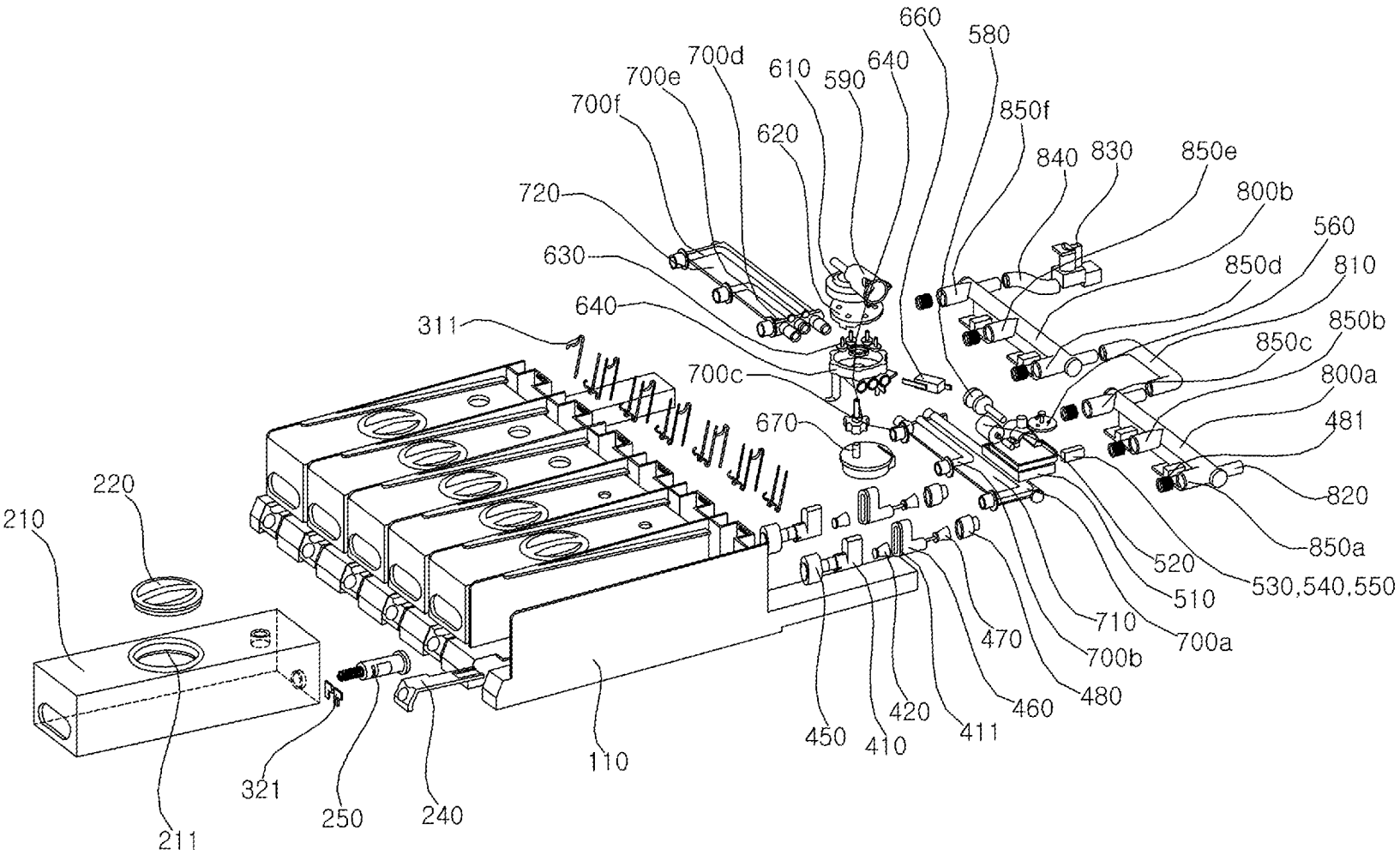
FIG. 8 is an exploded perspective view showing the detergent supply device shown in FIG. 5.
Figure 9:
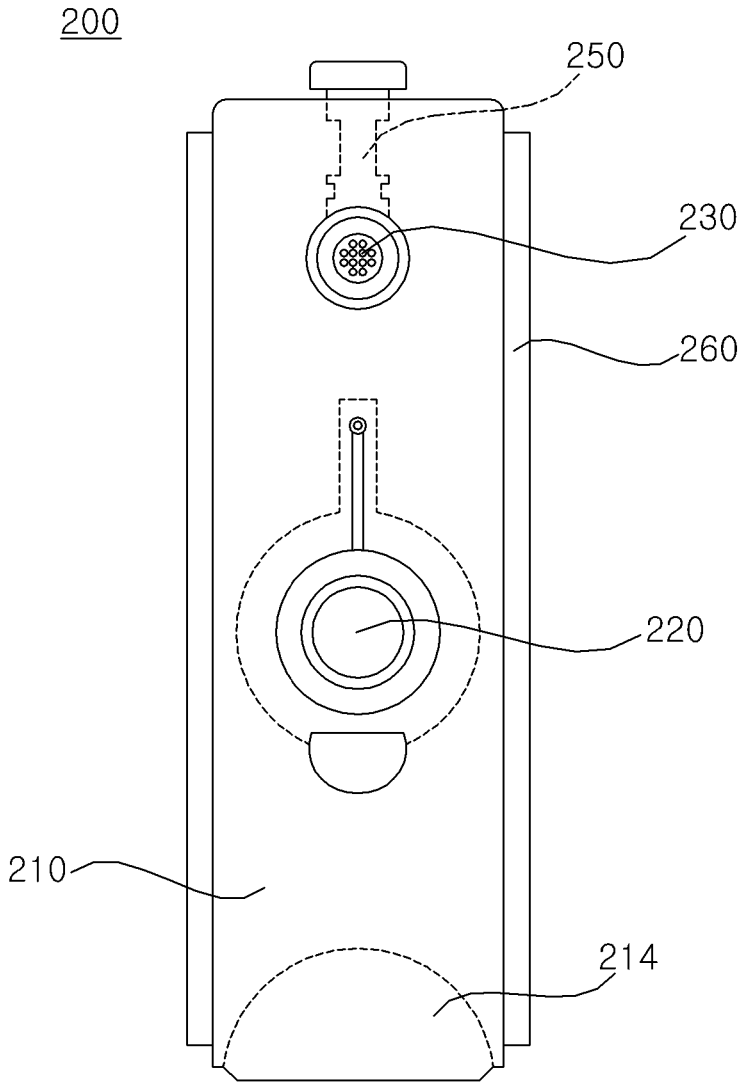
FIG. 9 is a plan view showing a cartridge of the detergent supply device shown in FIG. 8.
Figure 10:
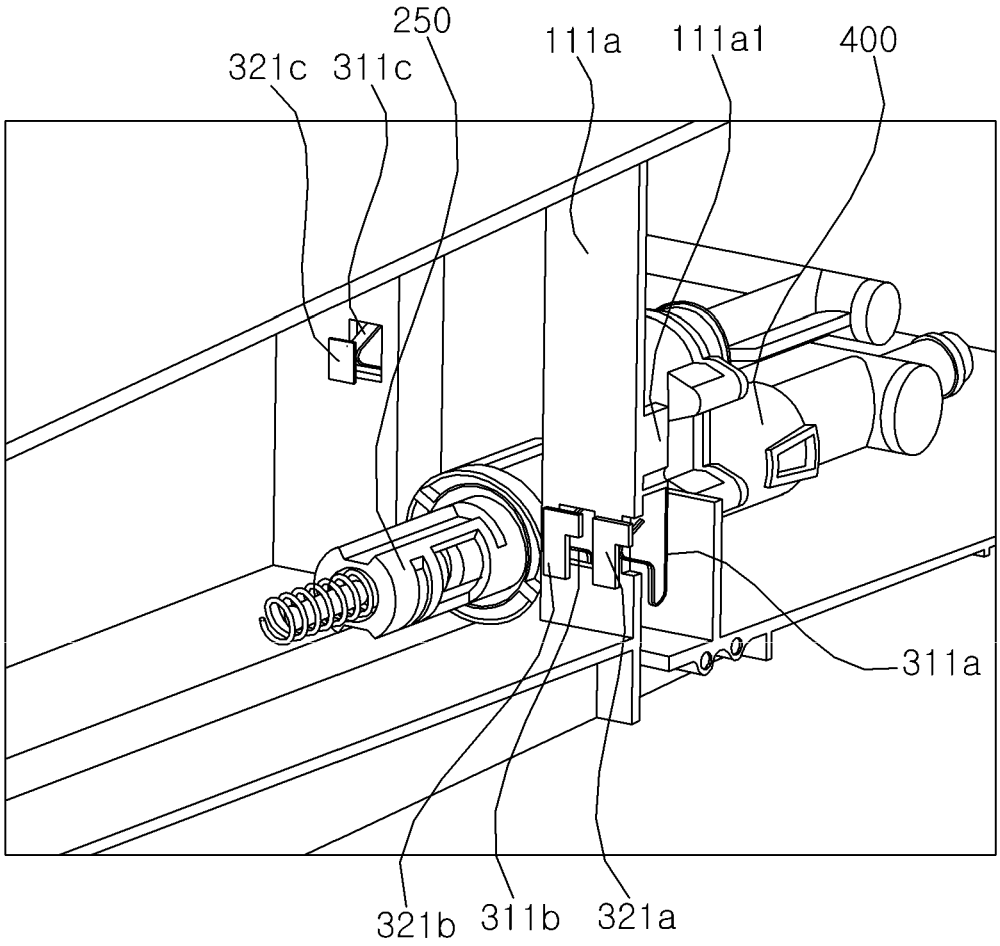
FIG. 10 is a schematic view showing an electrode sensor of the detergent supply device shown in FIG. 8.
Figure 11:
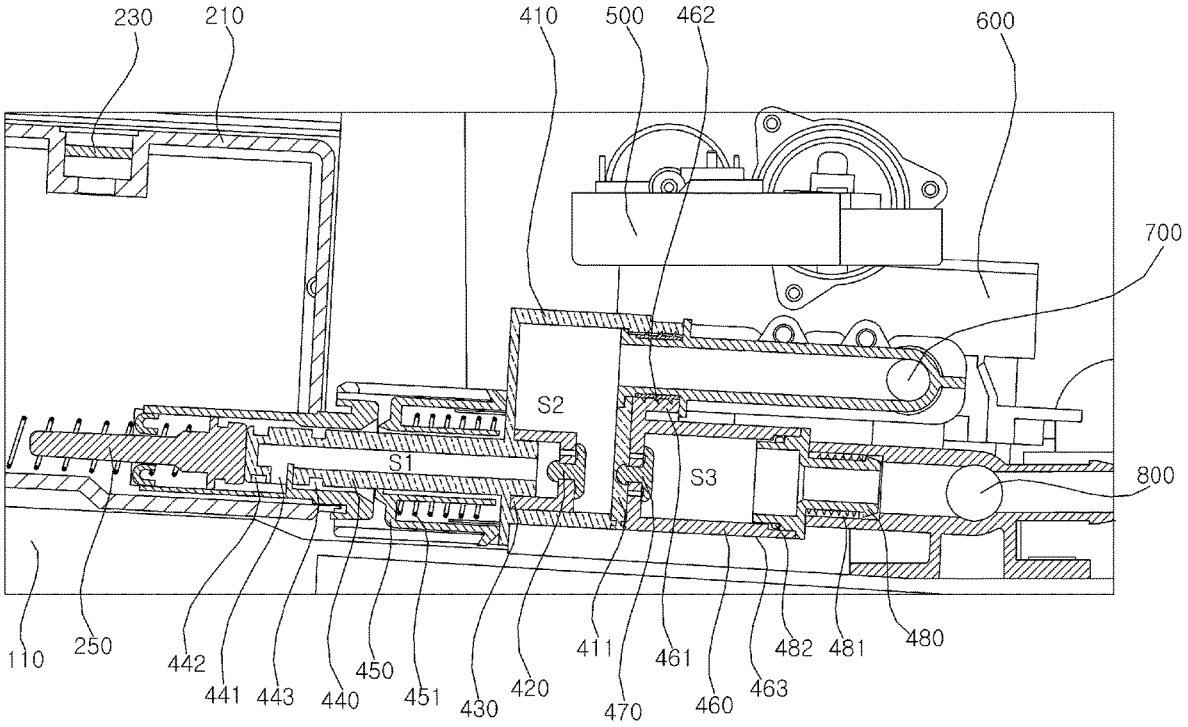
FIG. 11 is a schematic view showing a check valve assembly of the detergent supply device shown in FIG. 7.
Figure 12:
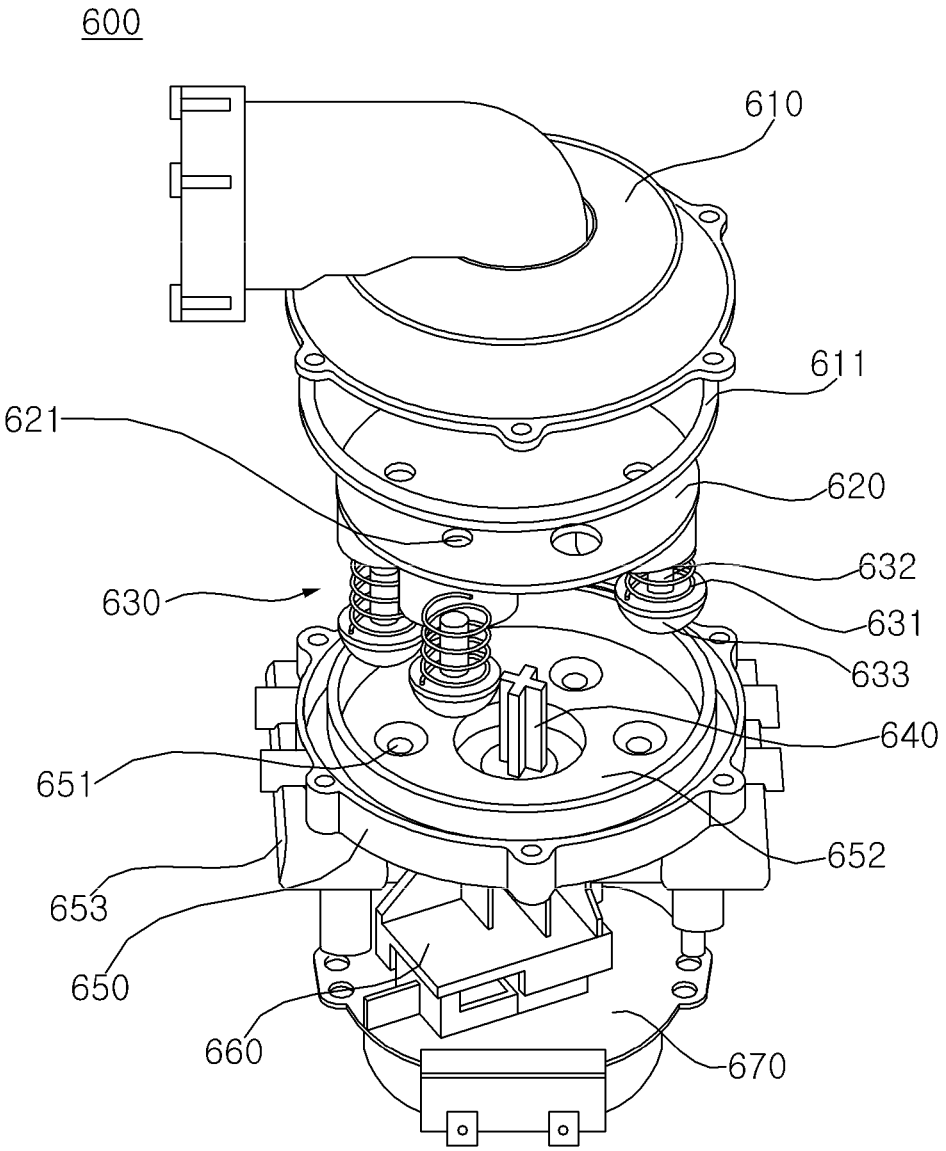
FIG. 12 is an exploded perspective view showing a passage switching valve of the detergent supply device shown in FIG. 6.
Figure 13:
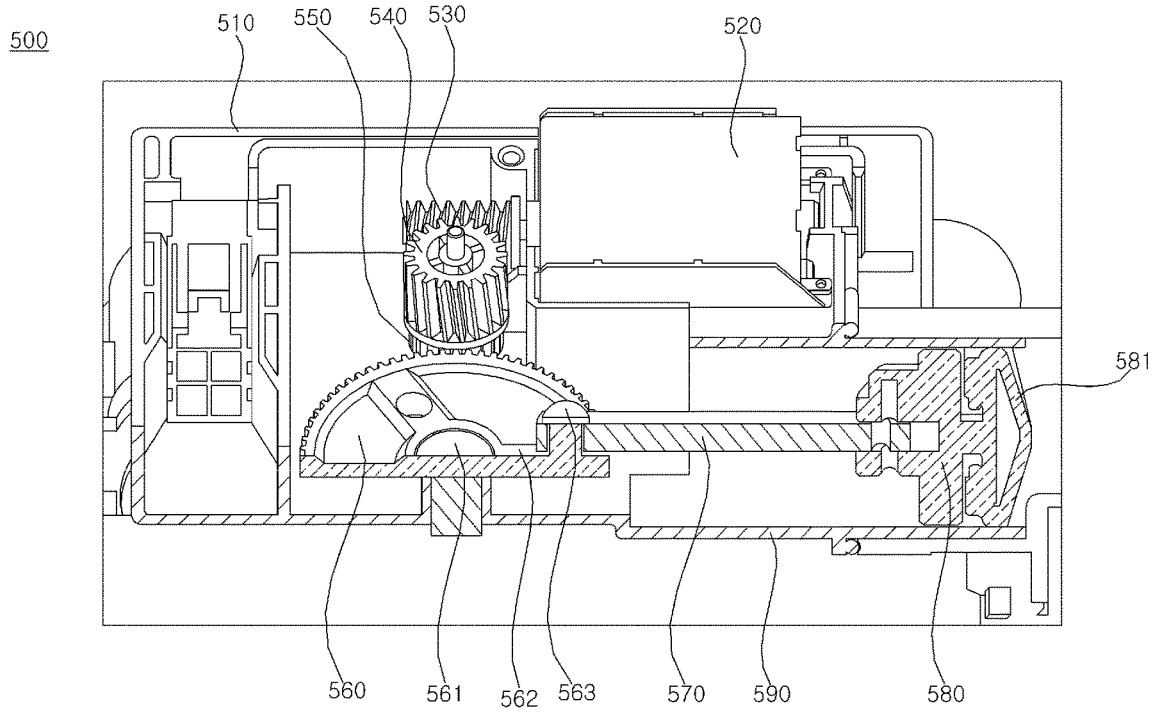
FIG. 13 is a schematic view showing a pump of the detergent supply device shown in FIG. 6.
Figure 14:
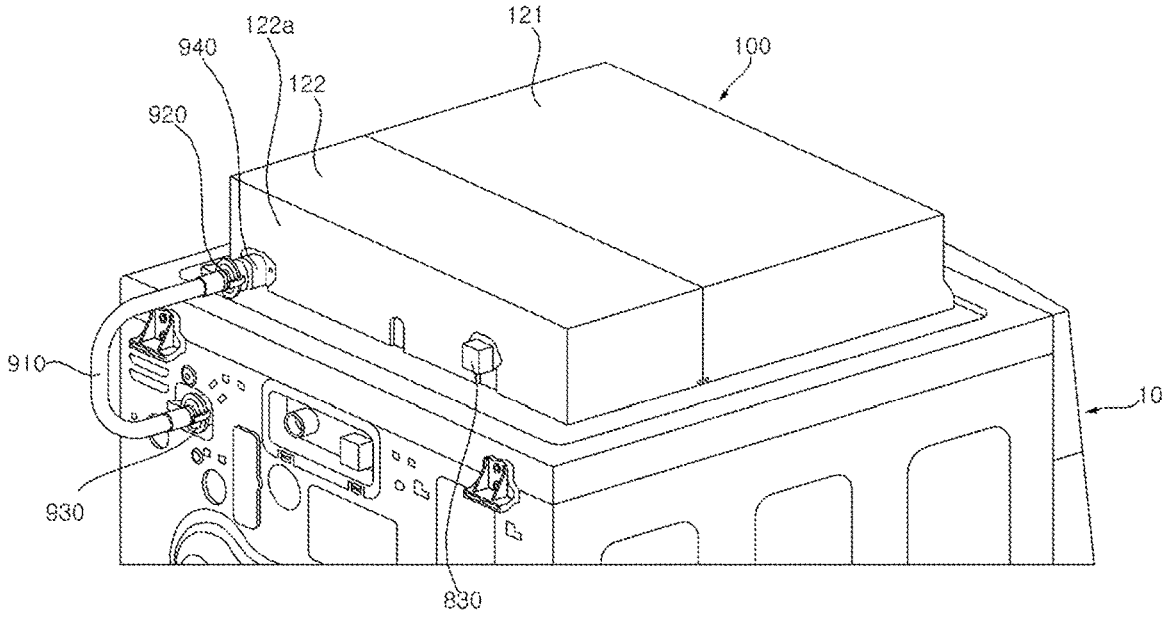
FIG. 14 is a schematic view showing a second external passage of the washing machine according to an exemplary implementation of the present disclosure.

Referring to FIG. 1 through FIG. 3, a washing machine according to an exemplary implementation of the present disclosure includes a cabinet 10 and a detergent supply device 100 disposed at an upper surface of the cabinet 10.

The cabinet 10 defines an outer appearance of the washing machine, and a tub 31 and a drum 32 are disposed in the cabinet 10. The cabinet 10 includes a main frame 11 having a front surface opened, a left surface 11*a*, a right surface 11*b* and rear surface 11*c*, a front panel 12 having a loading/unloading opening and connected to the front surface of the main frame 11, and a planar base 13 supporting the main frame 11 and the front panel 12 from the below. A door 14 opening and closing the loading/unloading opening is mounted rotatably to the front panel 12.

The front panel 12 and the tub 31 are communicated to each other with a circular gasket 33. A frontal end portion of the gasket 33 is mounted at the front panel 12, a rear end portion of the gasket 33 is mounted fixedly along a circumference of an inlet of the tub 31. The gasket 33 is formed as a material having elasticity and capable of preventing water in the tub 31 from leaking.

A driving portion 15 may be disposed at a rear side of the drum 32 so as to rotate the drum. Further, there may be provided a water supply hose guiding water supplied from an external water source and a first water supply valve 37 controlling water supplied from the water supply hose to a water supply passage 36. The water supply valve 37 may supply water to the drawer 38 through the water supply passage 36.

The cabinet 10 includes a drawer 38 accommodating detergent and a drawer housing 40 accommodating the drawer 38 so that the drawer 38 is withdrawable therefrom. The detergent may also include bleach or fabric softener as well as detergent for laundry. Detergent accommodated in the drawer 38 is provided to the tub 31 through a first passage 35 when water is supplied through water supply passage 36. A water supply opening may be disposed at a lateral surface of the tub 31. According to an exemplary implementation of the present disclosure, the first passage 35 may be a bellows, but is not limited thereto. Rather, the first passage 35 may be formed of various material and shape.

The tub 31 may include a drain discharging water, and a drain bellows 17 may be connected to the drain. A drain pump 19 pumping water discharged from the tub 31 through the drain bellows 17 so as to discharge the water to the outside of the washing machine. Further, a vent pipe 39 is installed at the tub 31 so as to allow air to flow to the outside.

Hereinafter, referring to FIG. 1 through FIG. 8, a detergent supply device 100 disposed at an upper surface of the cabinet according to an exemplary implementation of the present disclosure will be described.

The water supply device 100 includes a housing 110 having a door disposed at a front side thereof and defining an accommodating room inside thereof, and a cover 120 opening and closing the housing 110.

An opening formed as a rectangular cuboid made of various surfaces may be disposed at a front side of the housing 110, and each of the opening is extended from a rear side of the housing 110 so as to form a room for a cartridge corresponding to each of the opening. That is, each of a plurality of cartridges 200*a*, 200*b*, 200*c*, 20*d*, 200*e*, 200*f* (hereinafter referred to as "200") may be inserted to each opening room.

Detergent is accommodated in each of the cartridges 200, and preferably each detergent may have differential composition ratio. Although the number of cartridges according to an exemplary implementation of the present disclosure may be six, the number of the cartridges is not limited to any particular number, and it is preferable to employ three cartridges or more.

An accommodating room for accommodating passages 700, 800, a passage switching valve 600 and detergent supply parts such as a pump 500 etc. may be disposed at a rear room of an accommodating room for the cartridge 200. A rear wall 111 is disposed between the accommodating room for the cartridge and the accommodating room for the accommodating room, and further a terminal and an electrode sensor 300 are installed at the rear walls.

The pump 500 and the passage switching valve 600 may be controlled by a controller 3. Information about contents of detergent and various composition ratio of contents may be stored in a memory 4. One of the contents is accommodated in each of the cartridges 200, and the controller 3 controls the pump 500 and the passage switching valve 600 according to information stored in the memory 4.

The washing machine may further include an input unit 5 for obtaining various control command related with an operation of the washing machine from a user. The input unit 5 may be disposed at an upper side of the front panel 12. A display 6 indicating the operating status of the washing machine may be disposed at the front panel 12.

The controller 3 may select a type of detergent from the memory 4 according to a setting value that a user inputs with the input unit 5, and the controller 3 may identify information about the detergent. And then, the controller 3 may control the pump 500 and the passage switching valve 600 so as to eject the selected detergent. Thus, the controller 3 may control the pump 500 corresponding to the cartridge 200 accommodating the selected detergent according to the composition ratio and the passage switching valve 600. In some cases, the controller 3 may include at least one of an electric circuit, one or more processors, a non-transitory memory, or a communication device.

Hereinafter, referring to FIG. 5 through FIG. 8 and FIG. 9, cartridges 200 installed at the detergent supply device according to an exemplary implementation of the present disclosure will be described.

The cartridges 200 may include a cartridge body 210 accommodating detergent, a detergent inlet 211 for injecting detergent into the cartridge body, cap 220 for opening and closing the detergent inlet 211, membrane 230 allowing air in the cartridges to flow to the outdoor, cartridge locker 240 allowing the cartridge 200 to fixedly connect to the housing 110 in a case that the cartridge is inserted to the housing 110, a docking valve 250 connecting a check valve 400 and the cartridge 200 and rib 260 preventing detergent from being contacted to the membrane 230. In some cases, the cartridge 200 may be disposable.

The cartridge body 210 may be formed such as being corresponded to the appearance of the housing 110 so that the cartridge body 210 can be snugly inserted to the accommodating room disposed at a front side of the housing 110. According to an exemplary implementation of the present disclosure, a cartridge accommodator takes the form of rectangular, and also the cartridge 200 takes the form of rectangular corresponding to the appearance of the cartridge accommodator, and further the cartridge accommodators may have rounded corner so as to reduce abrasion occurred during assembling and disassembling of the cartridge 200.

The detergent inlet 211 may be disposed at a front side of the cartridge body 210, and a cap 220 opening and closing the detergent inlet 211 may be disposed at the detergent inlet 211. When it is required to put detergent into the washing machine, detergent is put into the cartridge body 210 by opening the cap 220. The cap 220 must then be closed after finishing putting detergent therein so as to prevent detergent from being discharged to the outside.

The membrane 230 allowing the air of the cartridge to flow to the outdoor may be mounted at a front upper side of the cartridge body 210. The membrane 230 may keep a pressure of the cartridge and an external pressure the same so as to prevent detergent of the cartridge from supplying to the check valve inadvertently. Further, it is impossible for liquid-phase detergent to discharge to the outdoor through the membrane 230, so it can be possible to prevent detergent from being harden by evaporation.

The cartridge locker 240 is disposed at a front surface of the cartridge accommodator 110 and a lower side of the cartridge. The cartridge locker 240 may secure the cartridge 200 for preventing the cartridge from being disassembled when the cartridge is snugly inserted thereto.

The docking valve 250 is disposed between a check valve assembly 400 and the cartridge 200 so as to connect the check valve assembly 400 with the cartridge, and so detergent of the cartridge may be supplied to an inlet passage 700 or an outlet passage 800 through the check valve assembly 400.

The rib 260 is mounted at the both sides of the cartridge body 210 so as to function as a guide allowing the cartridge 200 to be inserted into the cartridge accommodator 110 easily, and further the rib 260 may allow the cartridge body 210 to be arranged in a slanted manner such that detergent does not come in contact with the membrane 230 in a case that the cartridge is leaned.

Hereinafter, referring to FIG. 5 through FIG. 8 and FIG. 10, structure and operation of an electrode sensor 300 disposed at a rear side of the cartridge will be described.

The electrode sensor 300 according to an exemplary implementation of the present disclosure is installed at a rear wall 111*a* formed as a housing 110 at a rear side of the cartridge 200. Specifically, electrode plates 321*a*, 321*b*, 321*c* (hereinafter referred to as "321") are installed between the rear wall and the cartridge body 210. A terminal 311*a* as an example among terminals 311*a*, 311*b*, 311*c* provided is installed at a rear protrusion 111*a*1 protruding toward a rear side of the detergent supply device at the rear wall.

The electrode plate 321 is connected to the terminal 311 through a rear wall electrode plate opening. The electrode plate 321 is contacted to an inner side of the cartridge through the cartridge electrode plate opening, so a front side thereof can be electrified by being contacted with detergent contained in a cartridge, and then an electric signal can be transmitted to the controller 3 through the terminal.

In some implementations, there may be provided three terminals and three electrode plates per one cartridge. A first terminal, a first electrode plate, a second terminal and a second electrode plate are disposed at a side based on a lower side of a cartridge and the docking valve 250.

The third terminal and the third electrode plates are disposed at the opposite side based on a lower side of a cartridge and the docking valve.

The electrode sensor 300 outputs a signal when a positive electrode and a negative electrode are electrified through a medium in a state that the positive electrode and the negative electrode are disposed adjacently to each other. Thus, when there is enough detergent contained in a cartridge, detergent functions as a medium for electrifying the electrode sensor 300, and a result for the foregoing the terminal detects a residual amount of detergent in the cartridge.

In a case that there provided with two electrode plates 321 and two terminals 311 per a cartridge, the electrode sensor may hardly accurately detect residual amount of detergent contained in a cartridge due to sway of the cartridge or to hardened detergent on the electrode sensor.

According to an exemplary implementation of the present disclosure, the first and second electrode plates 321*a*, 321*b* are formed as separate electrode plates, and is installed at a lower side of the cartridge 200. The third electrode plate 321*c* is installed at an upper side of the cartridge 200, so a first signal can be obtained when the first and second electrode plates 321*a*, 321*b* are electrified. A second signal can be obtained when the second and third electrode plates are electrified. It is possible to detect an amount of detergent contained in the cartridge 200 by adding the first signal and the second signal, and to determine that if it is misjudgment of the electrode sensor and if the electrode sensor is unmounted as well.

Specifically, when the first and second signals are not detected, it is determined that the cartridge is almost empty or unmounted. When the second signal is only detected, it is determined that the electrode sensor is malfunctioned or in a bad connection. When the first signal is only detected, it is determined that the cartridge is out of detergent. When the first signal and the second signal are detected, it is determined that the cartridge is filled with enough detergent.

In some cases, a display 6 for showing user a result of determination according to the first and second signals is provided. In some cases, according to one implementation, there is provided the electrode sensor having the first and second electrode plates disposed at a lower side of the electrode sensor and the third electrode plate disposed at an upper side of the electrode sensor, but is not limited thereto. Rather, it can be preferable to employ at least three electrode plates or more in which the at least one of the at least three electrode plates may have a different height from the others so as to decrease a chance to misjudge of amount of detergent.

According to an exemplary implementation of the present disclosure, the first and second electrode plates 321*a*, 321*b* take the form of L-shape rather than a rectangular shape as conventional manner. This is because when the two electrode plates are disposed closely adjacently each other, the electrode sensor would misjudge an amount of detergent due to electric signal occurred by an interference between the electrode plates. At this time, it is possible to minimize the interference therebetween when the electrode plate may have a lower end of smaller width which is contacted with detergent. Herein, a shape of the two electrode plates is not limited to the L-shape according to an exemplary implementation of the present disclosure, rather it is preferable to employ a shape capable of minimizing the interference between the two electrode plates.

Hereinafter, referring to FIG. 5 through FIG. 8 and FIG. 11, a structure and an operation related with the check assembly 400 will be described.

Check valves 400*a*, 400*b*, 400*c*, 400*d*, 400*e*, 400*f* (hereinafter referred to as "400") according to an exemplary implementation of the present disclosure may include a first check valve housing 410, a first check valve 420 installed at the first check valve housing 410, a check valve cap 430 for preventing detergent and air from leaking through the first check valve 420, a docking pipe 440 capable of moving detergent of the cartridge 200 toward the check valve in a state of being connected to the docking valve 250 of the cartridge 200, a docking pipe circumference 450, a second check valve housing 460, a second check valve 470 installed at the second check valve housing 460, and an outlet passage connecting pipe 480 connected to the outlet passage 800 in state of being connected to the second check valve housing 460.

A check valve o-ring 411 may be snugly inserted between the first check valve housing 410 and the second check valve housing 460 so as to connect the first check valve housing 410*a* to the second check valve housing 460 and function to provide airtight.

The first check valve 420 and the second check valve 470 according to an exemplary implementation of the present disclosure may be formed as rubber. As the result of the foregoing, there is no need to employ spring as conventional manner because it is possible to block one-way flow of fluid by using elastic force of rubber, so it is possible to minimize a space of the housing, and further to arrange various parts therein without any space loss.

The first check valve 420 and the second check valve 470 are disposed along the opposite direction to that of the cartridge 200. Thus, the first check valve 420 is capable of being opened only in a direction toward a second space S2, and the second check valve 470 is capable of being opened only in a direction toward a third space S3.

A detergent inlet 441 allowing detergent supplied from the cartridge 200 to inject to the docking valve are disposed at the docking pipe 440. A first docking pipe o-ring 442 and a second docking pipe o-ring 442 are snugly inserted to a first docking pipe o-ring groove 442 and a second docking pipe o-ring groove 443 so as to help prevent detergent from leaking to the outside while detergent is injected to the detergent inlet.

A docking pipe spring 451 is installed at the docking pipe circumference 450. The docking pipe spring 451 is capable of connecting fixedly the check valve assembly 400 to the docking valve 250 through an elastic force of the docking pipe spring, and further easily disassembling the cartridge 200 from the housing 110 through the elastic force of the docking pipe spring.

An inlet passage connector 461 connected to the inlet passage 700 and an outlet passage connector 463 connected to the outlet passage 800 are installed at the second check valve housing 460. The inlet passage connector 461 is snugly connected to the inlet passage 700 through the inlet passage connector cover 462.

The outlet passage connecting pipe 480 is fixedly connected to an end of the outlet passage connector 463*a* by an outlet passage connecting o-ring 482. The outlet passage connecting pipe 480 is snugly connected to the outlet passage 800 by an outlet passage connecting cover 481.

Negative pressure or positive pressure generated by a reciprocating movement of a piston body 580 disposed at the pump 500 is transmitted to the second space S2 of the check valve assembly 400*a* through the inlet passage 700.

According to an exemplary implementation of the present disclosure, a negative pressure generated by reverse movement of the piston body 580 is guided to the second space S2 through the inlet passage 700. Thus, the first check valve 420*a* is opened by the negative pressure in the second space S2. At this time, detergent of the cartridge 200*a* is guided to the second space S2 by the negative pressure generated in the second space S2 via the first check valve 420 after passing through the first space S1 of the docking pipe 440.

When the detergent moves to the second space S2, the piston body 580 moves forward and then a positive pressure generated by the movement as above is again guided to the second space S2 through the inlet passage 700. At this time, the second check valve 470*a* is opened by a positive pressure in the second space S2, and the first check valve 420 is kept closed. Therefore, detergent in the second space S2 is guided to the third space S3 of the second check valve housing 460 by a positive pressure generated in the second space S2. Detergent guided to the third space S3 is discharged to the outlet passage 800 by positive pressure generated in the second space S2 and the third space S3 so as to be provided to the tub 31 or drawer 38 etc. with water supplied.

Hereinafter, referring to FIG. 5 through FIG. 8 and FIG. 13, a structure and an operation of the pump 500 will be described.

A pump 500 according to an exemplary implementation of the present disclosure includes a pump housing 510 accommodating pump parts, a motor 520 generating power, a first gear 530 rotated by the motor 520, a second gear 540 rotating in a state of being engaged with the first gear 530, a third gear 550 rotating in a state of being engaged with the second gear 540, a crank gear 560 rotating in a state of being engaged with the third gear 550, a connecting rod 570 connecting the crank gear 560 to the piston 580, a piston 580 guiding positive pressure or negative pressure to the passage switching valve 600 using by reciprocating movement and a cylinder 590 defining a space wherein the piston's reciprocating.

The first gear 530 is engaged with the motor 520 so as to be integrally rotated with the motor 520. The first gear 530 may be a helical gear. A helical gear may have an advantage of reducing a noise occurred by the motor 520 and of easily transferring power. The second gear may be a worm gear. Since the pump 500 is installed between the inlet passage 700, the outlet passage 800 and the passage switching valve 600 etc., there can be a need to assemble with high density for space efficiency. Therefore, according to an exemplary implementation of the present disclosure, the motor 520 may be installed horizontally, and the second gear 540 may function as a worm gear so as to switch a direction of rotating power and deliver thereto.

The second gear 540 and the third gear 550 are integrally rotated. The crank gear 560 is rotated in a state of being engaged with the third gear 550. The crank gear 560 may have the greater number of teeth than that of the third gear 550 so as to deliver strong power thereto during reciprocating movement of the piston 580.

The crank gear 560 includes a crank shaft 561 functioning as a rotating axis of the crank gear, a crank arm 562 extended from the crank shaft and a crank pin 563 connected to the connecting rod 570. The crank pin 563 and the connecting rod 570 are rotatably connected to each other so that the connecting rod 570 is capable of linearly moving along a direction of the cylinder 590 according to rotation of the crank pin 563 during rotation of the crank gear 560.

The connecting rod 570 is connected to the piston 580, and the piston 580 is snugly inserted to the cylinder 590 so as to move reciprocatively along a longitudinal direction of the cylinder 590. At this time, positive pressure or negative pressure may be guided to the passage switching valve 600 connected to the cylinder 590 through a linear movement of the piston 580. When the piston 580 is moved toward the passage switching valve 600, positive pressure is guided to the passage switching valve 600. Conversely, when the piston 580 is moved along the opposite direction of the passage switching valve 600, negative pressure is guided to the passage switching valve 600.

Hereinafter, referring to FIG. 5 through FIG. 8 and FIG. 12 through FIG. 13, a structure of a passage switching valve 600 will be described.

A passage switching valve 600 according to an exemplary implementation of the present disclosure includes an upper housing 610 connected to the cylinder 590 of the pump 500, a lower housing 650 connected to the upper housing 610, a disc 620 rotatably disposed at a space between the upper housing 610 and the lower housing 650, a spring valve 630 disposed at the disc 620, a shaft 640 rotating the disc 620, a micro switch 660 disposed at a lower side of the lower housing 650 and a passage switching motor 670 rotating the shaft 640.

A passage connecting opening 651 respectively connected to an inlet passage 700 are disposed at the lower housing 650 so that fluid that has passed through a disc hole 621 of the disc 620 may be guided to the each inlet passage 700 through the passage connecting opening 651 via a passage outlet opening 653.

The spring valve 630 is installed at the disc hole 621 of the disc 620. The spring valve 630 includes a spring 631 providing an elastic force, a spring shaft 632 restricting the spring 631 from being separated and a cover unit 633 covering the passage connecting opening 651*a* with an elastic force of the spring 631.

Hereinafter, referring to FIG. 5 through FIG. 8 and FIG. 12 through FIG. 13, an operation of the passage switching valve 600 will be described.

When detergent is selected for being supplied, the passage switching motor 670 is operated by power supplied. The operated passage switching motor 670 functions to rotate the shaft 640 connected thereto and also the disc 620 connected to the shaft 640.

At this time, the spring valve 630 installed at the disc 620 may be also integrally rotated corresponding to a rotation of the disc 620, and when the passage connecting opening 651 of the lower housing 650 is placed at a position where the spring valve 630 is rotating, the cover unit 633 functions to block the passage connecting opening 651 with an elastic force of the spring 631.

The controller 3 may control a rotary angle of the disc 620 so as to prevent the spring valve 630 from being positioned at the passage connecting opening 651, and further to connect the check valve assembly 400 which is connected to a cartridge containing detergent for supply to the pump 500.

When the spring valve 630 is not positioned at the passage connecting opening 651, the pump 500 and the passage connecting opening 651 are opened and positive or negative pressure generated in the pump 500 is sequentially guided to the inlet passage 700 and the check valve assembly 400 through the passage connecting opening 651 so as to supply detergent contained in the cartridge 200 to the outlet passage 800.

Further, in order to block a flow path between the check valve assembly 400 connected to a cartridge containing detergent that does not need to be supplied and the pump 500, the spring valve 630 may be positioned at the passage connecting opening 651*a* connected to the check valve assembly 400, and then the controller 3 controls a rotary angle of the disc 620 so that the cover unit 633 blocks the passage connecting opening 651 with an elastic force of the spring 631.

When the spring valve 630 is positioned at the passage connecting opening 651, the pump 500 and the passage connecting opening 651 are closed, and because positive pressure or negative pressure generated in the pump 500 is not guided to the check valve assembly 400, detergent contained in a cartridge is not flowed.

In order to precisely control a rotary angle of the disc 620, there is a need to detect the rotary angle with the micro switch 660 and to put the disc 620 on a desired rotary angle.

When the spring valve 630 of the disc 620 is not placed at a position of the passage connecting opening 651, the spring valve 630 is kept compressed at an upper surface 652 of the lower housing 650. At this time, the spring valve 630 is placed at a position of the passage connecting opening 651 through a rotary of the disc 620 and then the spring valve 630 is extended, so that the passage connecting opening 651 is closed.

In order to supply various types of detergent, a plurality of passage connecting openings 651 may be opened, and there may be a plurality of spring valves 630 that serve to block the plurality of passage connecting openings.

Hereinafter, referring to FIG. 5 through FIG. 8, an inlet passage 700 and an outlet passage 800 will be described.

According to an exemplary implementation of the present disclosure, the inlet passage 700 is connected to the inlet passage connector 461 of the check valve assembly 400, and further the inlet passage 700 is connected to the passage outlet openings 653 of the passage switching valve 600 so as to deliver fluid guided by the pump 500 to the check valve assembly 400.

A plurality of inlet passages 700 are respectively connected to each of a plurality of inlet passage connectors 461 and each of a plurality of the passage outlet openings 653.

According to an exemplary implementation of the present disclosure, there may be the passage switching valve 600 disposed at a center thereof, three cartridges 200 disposed at both sides thereof and a check valve assembly 400 connected to the three cartridge 200.

The inlet passages 700*a*, 700*b*, 700*c* disposed at the left side thereof is respectively connected to the inlet passage connector 461 of the left check valve assemblies 400*a*, 400*b*, 400*c* and passage outlet openings 653 disposed adjacently at a left side of the passage switching valve 600.

The inlet passages 700*d*, 700*e*, 700*f* disposed at the right side thereof is respectively connected to the inlet passage connector 461 of the right check valve assemblies 400*d*, 400*e*, 400*f* and the passage outlet opening 653 disposed adjacently at a left side of the passage switching valve 600.

The inlet passages 700*a*, 700*b*, 700*c* disposed at a left side thereof through a first inlet passage plate 710 and the inlet passages 700*d*, 700*e*, 700*f* disposed at a right side thereof through a second inlet passage plate 720 are integrally disposed so as to fix the inlet passages, and fluid is stably supplied.

According to an exemplary implementation of the present disclosure, an outlet passage 800 is connected to an outlet passage connecting pipe 480 of the check valve assembly 400, and the outlet passage 800 functions to supply detergent supplied from the outlet passage connecting pipe 481 to the tub 31 or the drawer 38 through a provider 820.

A second water supply valve 830 is disposed at an end of the outlet passage 800 so as to supply water supplied from the outdoor water source to the outlet passage 800, and then water supplied from the second water supply valve 830 is guided to the outlet passage 800 via a water supply hose 840.

After water is supplied through check valve connectors 850*a*, 850*b*, 850*c*, 850*d*, 850*e*, 850*f* connected to the outlet passage connecting pipe 481 of the check valve assembly 400, the water is discharged to the provider 820 with detergent supplied to the outlet passage 800 while the water is flowed toward the provider 820 disposed at the other end of the outlet passage 800.

The check valve connector 850 is connected to a lateral surface of the outlet passage 800. Each of the check valve connector 850 is connected to each of the outlet passage connector 480, so detergent discharged from the outlet passage connector 480 is guided to the outlet passage 800 through the check valve connector 850.

According to an exemplary implementation of the present disclosure, the outlet passage 800 is installed such as being divided into a left outlet passage 800*a* and a right outlet passage 800*b* with respect to the passage switching valve 600, and a connecting hose 810 is installed between the left outlet passage 800*a* and the right outlet passage 800*b* so as to connect the left outlet passage 800*a* with the right outlet passage 800*b*. Herein, the connecting hose 810 takes the form of channel-shape so as to make a space for installing the passage switching valve 600, and further to prevent the outlet passage 800 from intervening the passage switching valve 600.

As can be seen from the forgoing, the drawer 38 and the tub 31 are connected through the first passage 35. In addition, the detergent supply device 100 is connected to the tub 31 through second passages 900, 990. The second passages 900, 990 allow detergent contained in a cartridge to be supplied to the tub 31.

The second passage 900, 990 include a second external passage 900 disposed outside the cabinet 10 wherein the second external passage 900 connects the detergent supply device 100 and a rear surface 10*a* of the cabinet 10 and allow detergent contained in the detergent supply device 100 to flow to the cabinet 10, and a second internal passage 990 allowing detergent supplied from the second external passage to be supplied to the tub 31 wherein the second internal passage 990 has an end connected to the second external passage 900 at a surface of the cabinet 10 and the other end connected to the tub 31.

In some cases, the first water supply valve 37 for supplying water to the drawer 38 may be provided, and the controller 3 may control the first water supply valve 37 to be on or off according to a need to supply water to the drawer 38.

Hereinafter, referring to FIG. 14 through FIG. 20D, the second external passage 900 according to an exemplary implementation of the present disclosure will be described.

The second external passage 900 includes a connecting hose 910 connecting the cabinet 10 with the detergent supply device 100, a first head 920 installed at an end of the connecting hose 910, the first head 920 connecting to the detergent supply device 100, a second head 930 installed at the other end of the connecting hose 910, the second head 930 connected to the cabinet 10, a cover connector 940 connecting the first head 920 with the detergent supply device 100, a cabinet connector 950 connecting the second head 930 with the cabinet 10, a connecting body 960 encompassing the connecting hose 910 and a body opening 970 formed at a center of the connecting body 960.

The second external passage 900 functions to guide detergent supplied from the outlet passage 800 of the detergent supply device 100 to the drawer 38 in the cabinet 10 or the tub 31.

A cover 120 of the detergent supply device 100 includes a first cover 121 covering a front side of a cartridge 200 and a second cover 122 covering a rear side of a space accommodating main parts except for a cartridge. The detergent supply device 100 is surrounded by the first cover 121 and the second cover 122.

The cover connector 940 is installed at a rear surface 122*a* of the second cover 122. The cover connector 940 includes a head connector 941 that may become connected by being inserted into the first head 920, a head mounter 942 mounting to the first head 920, a supporter 943 securing the cover connector 940 to a rear surface 122*a* of the second cover 122 and a supply connector 944 connecting the cover connector 940 to the outlet passage 800.

The head connector 941 is inserted to a space where the first head 920 is penetrating in which the head connector 941 functions to guide detergent and water discharged from the head connector 941 to the connecting hose 910 through the first head 920.

A ball 921 is installed at an inner circumference of the first head 920. When the first head 920 is inserted to the cover connector 940, the ball 921 is mounted to the head mounter 942 of the cover connector 940. Thus, the ball 921 and head mounter 942 are fixedly mounted so that a connection between the first head 920 and the cover connector 940 is not disassembled while fluid is discharged to the connecting hose 910.

The supporter 943 is formed as being plate-shaped perpendicular to a longitudinal direction of the first head 920 at a center of the first head 920. The plate-shaped supporter 943 may contact and become mounted to a rear surface 122*a* of the second cover 122, so the supporter 943 functions to secure the cover connector 940 so as not to be swayed by an oil pressure. According to an exemplary implementation of the present disclosure, a hole may be formed at the supporter 943 so as to be bolted to the rear surface 122*a* of the second cover 122, but is not limited thereto.

The supply connector 944 is connected to the provider 820 of the outlet passage 800, and the supply connector 944 guides water including detergent discharged from the outlet passage 800 to the connecting hose 910.

The cabinet connector 950 is installed at a rear surface 10*a* of the cabinet 10. The cabinet connector 950 is connect the second external passage 900 to the second internal passage 990.

The cabinet connector 950 includes a head connector 951 that may become connected by being inserted into the second head 930, a head mounter 952 mounted to the second head 930, a supporter 953 securing the cabinet connector 950 to a rear surface 10*a* of the cabinet 10 and an inlet connector 954 connecting the cabinet connector 950 to the tub 31 or drawer 38.

The head connector 951 is inserted to a space where the second head is penetrating, and the head connector 951 functions to guide water and detergent discharged from the connecting hose 910 and the second head 930 to the tub 31 or the drawer 38 inside the cabinet 10.

A ball 931 is installed at an inner circumference of the second head 930. When the second head 930 is inserted to the cabinet connector 950, the ball 931 is mounted to the head mounter 952 of the cover connector 940. Thus, the ball 931 and the head mounter 952 are fixedly mounted so that a connection between the second head 930 and the cabinet connector 950 is not disassembled by an oil pressure while fluid is discharged to the tub 31 inside the cabinet 10 or the drawer 38.

The supporter 953 is formed as being plate-shaped perpendicular to a longitudinal direction of the first head 930 at a center of the second head 930. The plate-shaped supporter 953 is may come into contact with and become mounted to a rear surface 10*a* of the cabinet 10, so the supporter 953 functions to secure the cabinet connector 950 so as not to be swayed by an oil pressure. According to an exemplary implementation of the present disclosure, a hook may be disposed at the supporter 953 so as to be engaged with the rear surface 10*a* of the cabinet 10, but is not limited thereto.

The inlet connector 954 may be connected to the tub 31 or the drawer 38. In a case that the inlet connector 954 is connected to the tub 31, detergent had passed through the inlet connector 954 may be directly supplied to the tub 31. In a case that the inlet connector 954 is connected to the drawer 38, detergent had passed through the inlet connector 954 may be supplied via the drawer 38 to the tub 31.

The first and second heads 920, 930 are detachably connected respectively to the first and second connectors 940, 950. That is, if the detergent supply device is not in use, the first and second heads 920, 930 may be separated from the first and second connector 940, 950 so that the second external passage 900 is separated from the cabinet 10 and the detergent supply device 100. Conversely, if the detergent supply device is in use, the first and second heads 920, 930 may be mounted to the first and second connectors 940, 950 so that the second external passage 900 is mounted to the cabinet 10, and the detergent supply device 100 in order to supply detergent of the detergent supply device 100 to the tub 31 inside the cabinet 10.

The cover connector 940 is installed at the rear surface 122*a* of the second cover 122, and the cabinet connector 950 is installed at the rear surface 10*a* of the cabinet 10, and then the second external passage 900 is installed at a rear side of the cabinet 10. In other words, because the second external passage 900 is installed at a position where is not visible to a user, thereby minimizing unnatural appearance with other configuration nearby.

Figure 15:
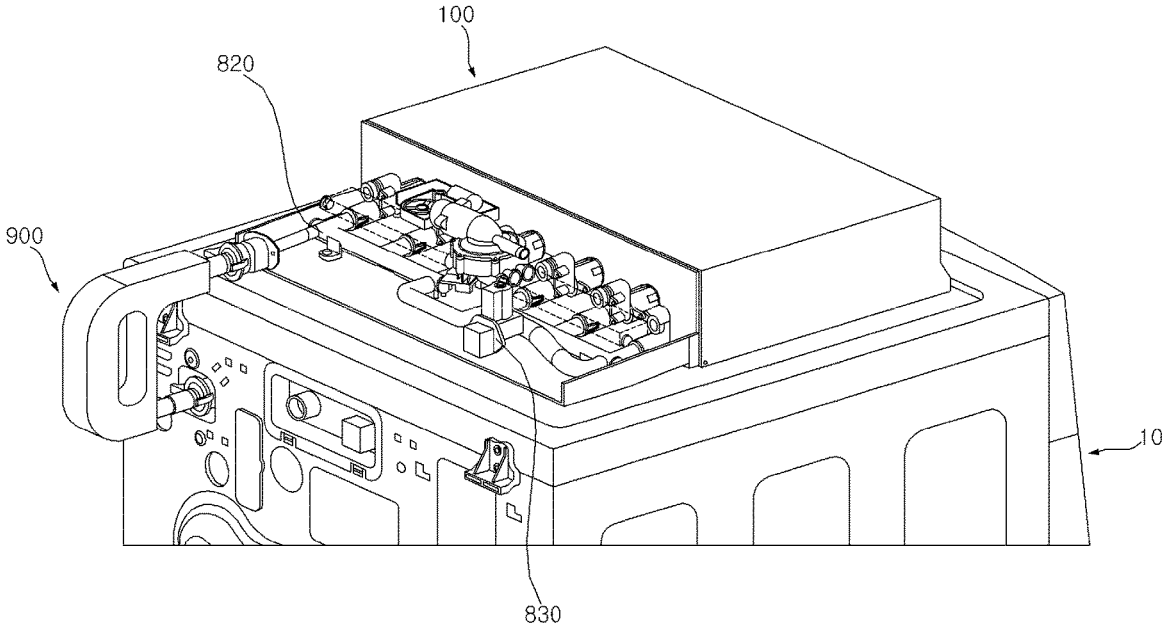
FIG. 15 is a schematic view showing the second external passage including a connecting body and an outlet passage connected to the second external passage.
Figure 16:
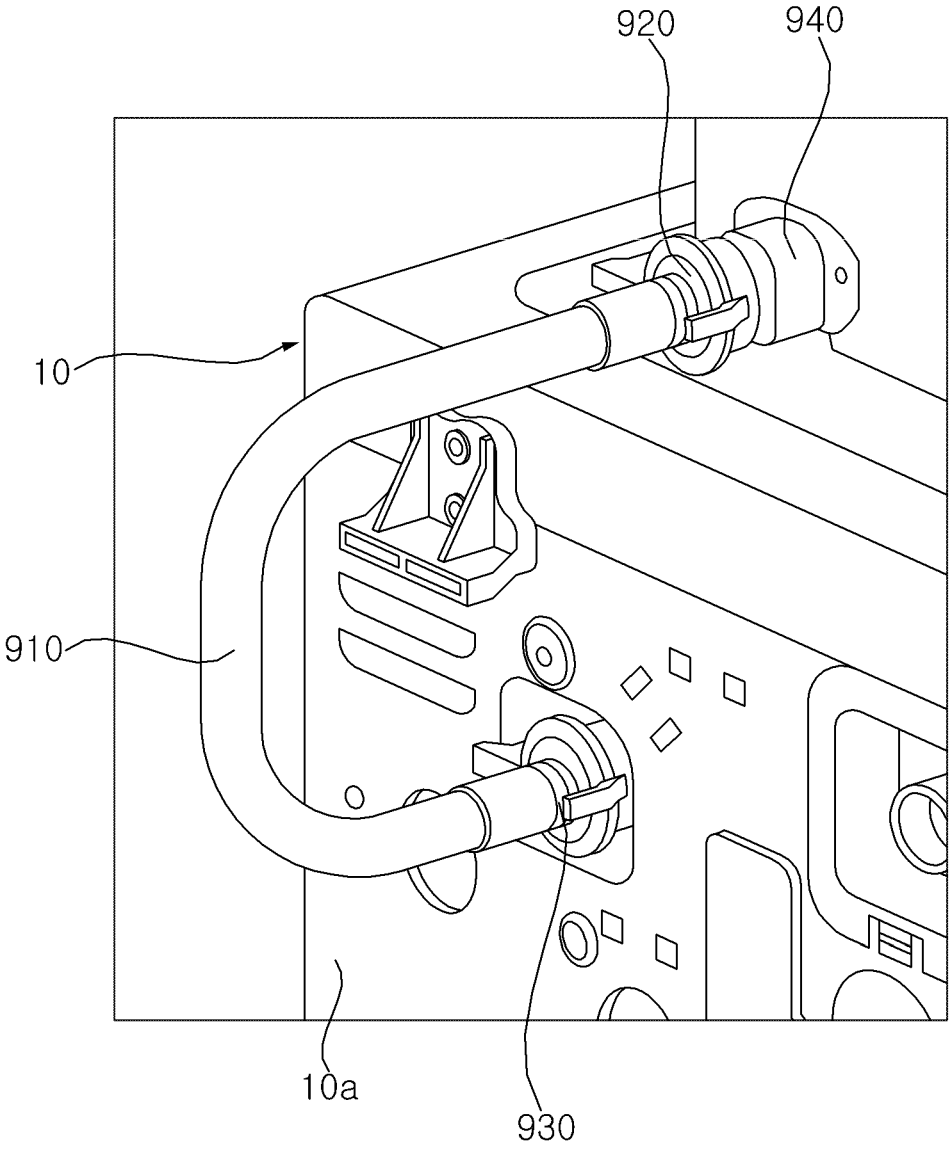
FIG. 16 is an enlarged view showing the second external passage shown in FIG. 14.
Figure 17:
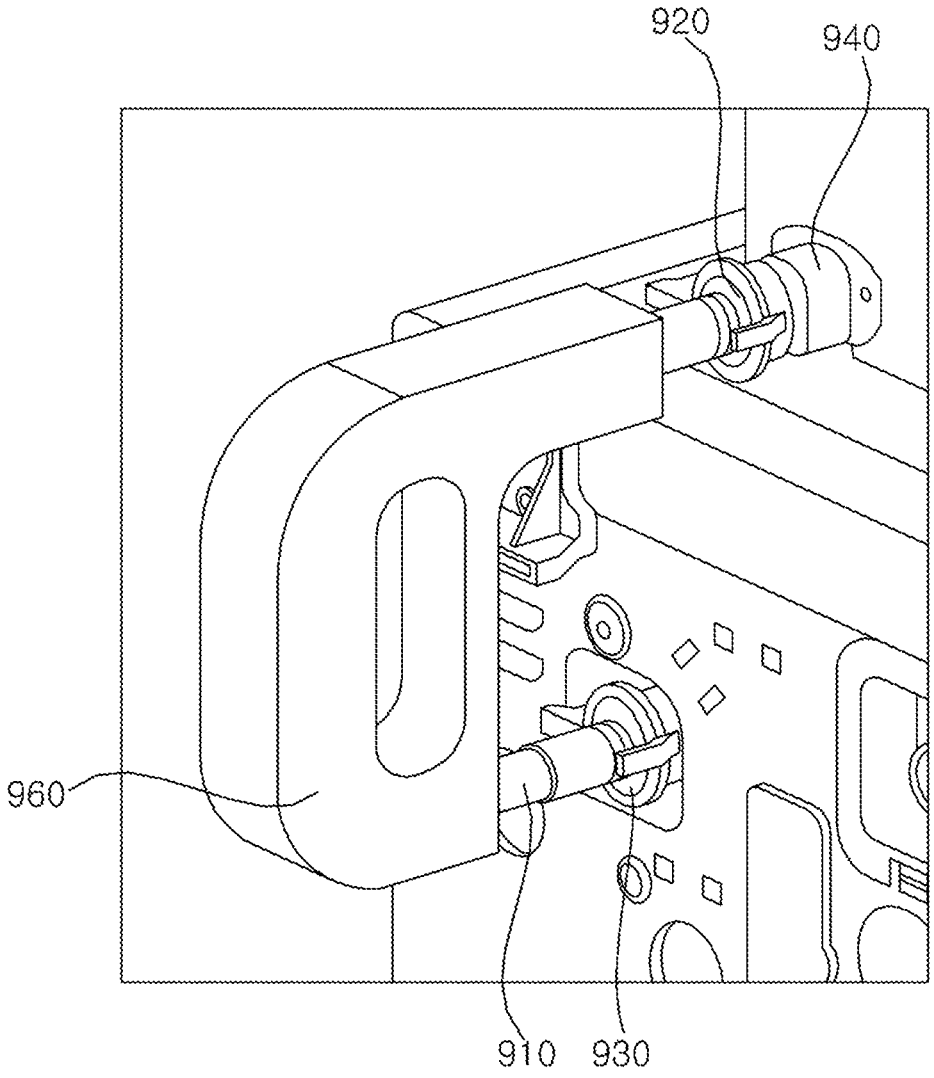
FIG. 17 is an enlarged view showing the second external passage shown in FIG. 15.
Figure 18:
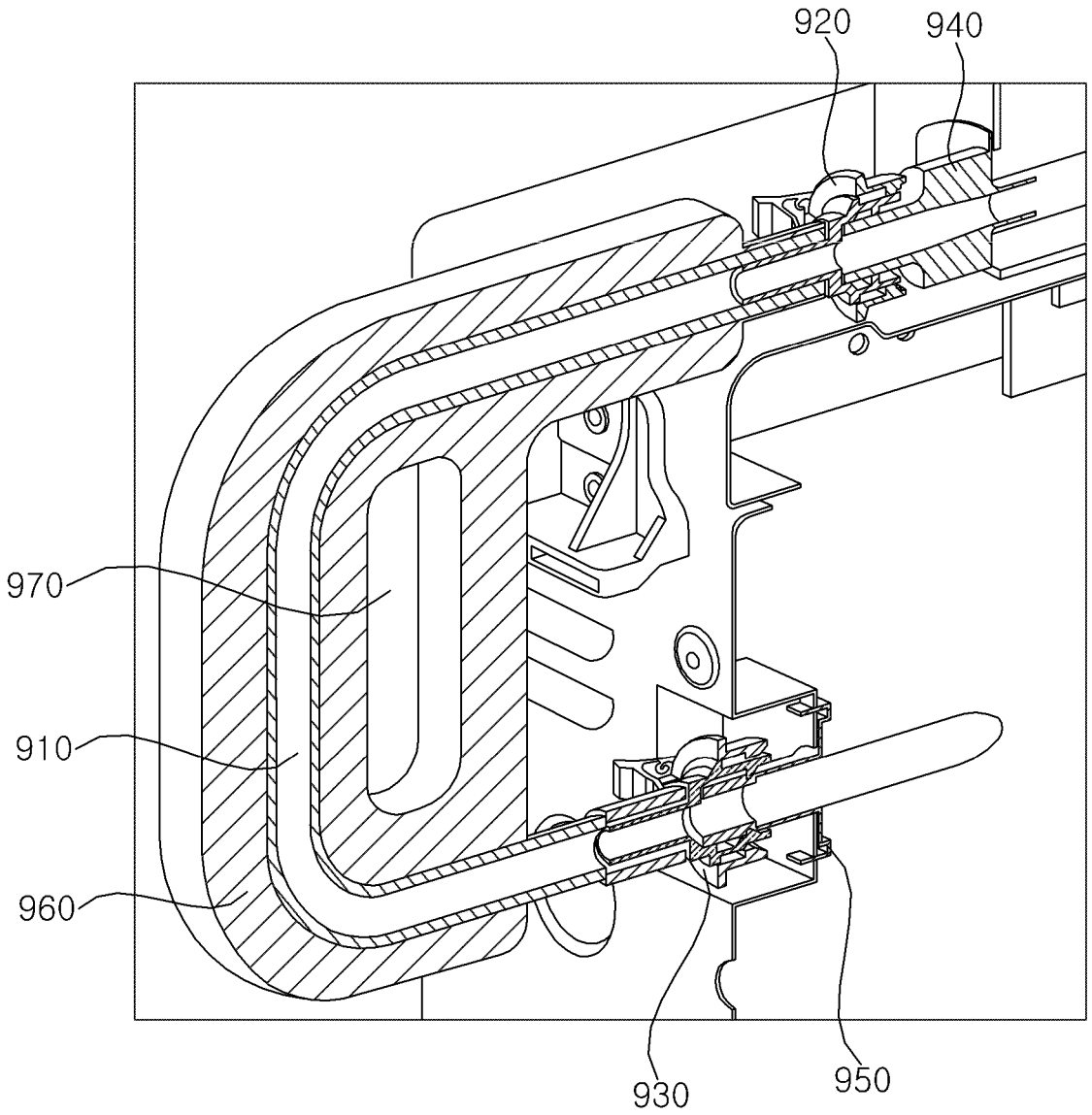
FIG. 18 is a cross-sectional view showing the second external passage shown in FIG. 17
Figure 19:
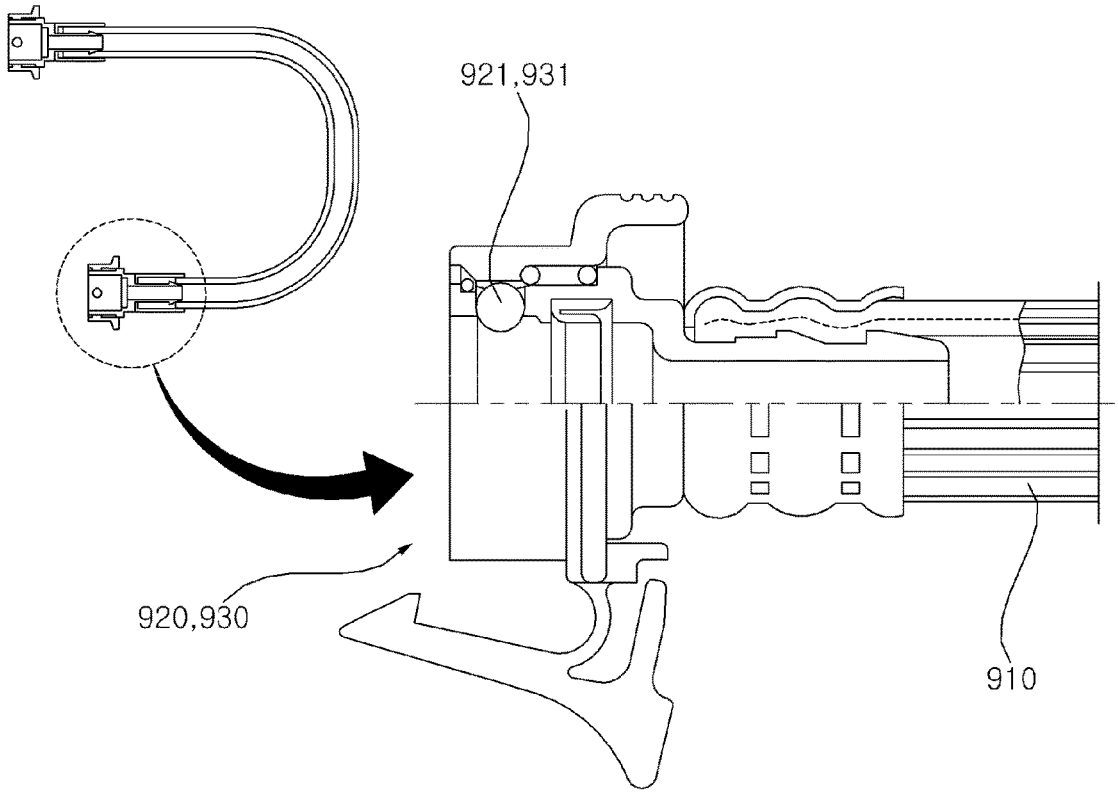
FIG. 19 is an enlarged view showing the second external passage and a head shown in FIG. 16.
Figure 20A:
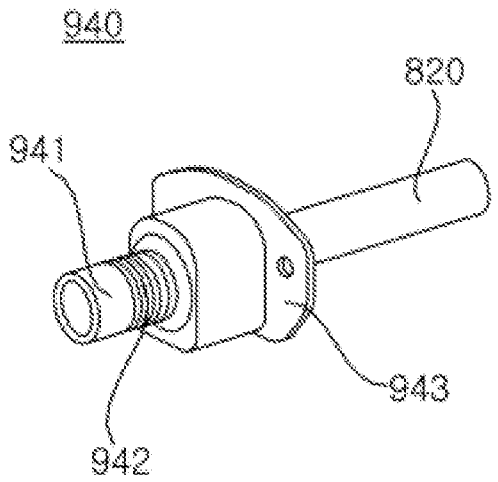
Figure 20B:
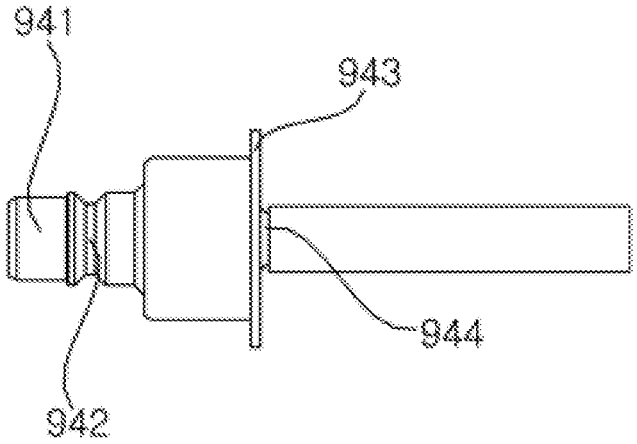
Figure 20C:
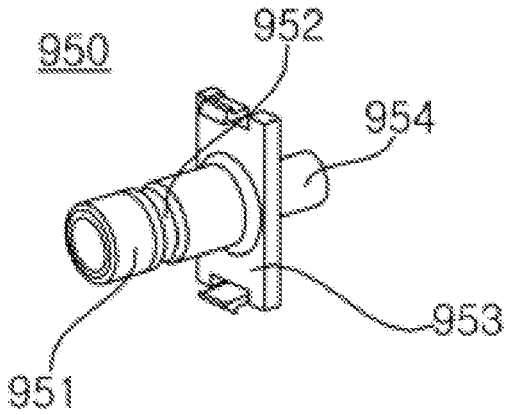
Figure 20D:
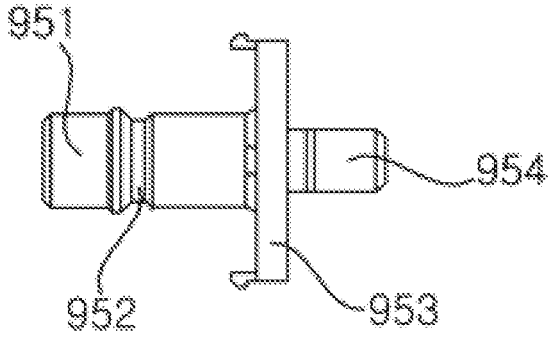

Referring to FIG. 15, FIG. 17 and FIG. 18, the second external passage 900 may further include the connecting body 960 encompassing the connecting hose 910. The connecting body 960 is formed as rigid materials, while the connecting hose 910 is formed as flexible materials. Thus, it is possible to easily assemble or disassemble the second external passage 900 by grabbing a body opening 970 of the connecting body 960.

In order to supply detergent via the detergent supply device to a main washing machine disposed at the cabinet 10, it may be required to determine a state of connection between the main washing machine and the detergent supply device 100, and in doing so, information related with a laundry identified from the main washing machine is transmitted to the detergent supply device 100. Accordingly, an appropriate detergent corresponding to the laundry should be supplied from the detergent supply device 100.

Figure 21:
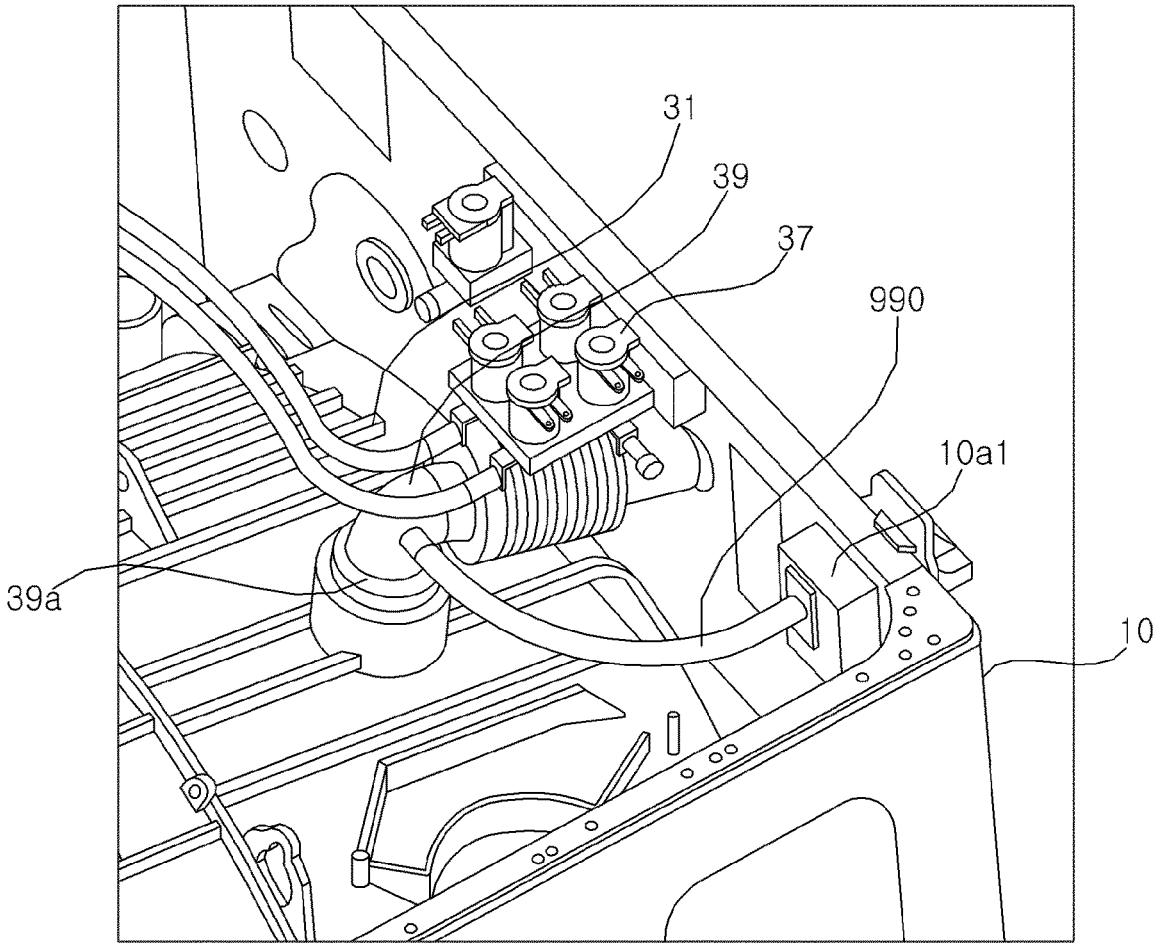
FIG. 21 is a schematic view showing a second internal passage of the washing machine according to the first implementation of the present disclosure.

Hereinafter, referring to FIG. 21, a second internal passage 990 of washing machine according to the first implementation of the present disclosure will be described.

There is employed with the vent pipe 39 connecting an upper side of the tub 31 to the rear surface 10*a* of the cabinet 10. The vent pipe 39 functions to allow an inner side of the tub 31 to be in communication with an outer side of the cabinet 10 so that air in the tub 31 can circulate to the outside. That is, it is possible to reduce a chance that mold or the like would form inside the tub 31 due to humidity and also possible to allow water that has permeated into the tub 31 to be discharged to the outside.

According to an exemplary implementation of the present disclosure, an end of the second internal passage 990 is connected to the cabinet connector 950, and the other end thereof is connected to a side of the vent pipe 39 so that detergent supplied from the detergent supply device 100 is supplied via the second internal passage 990 and the vent pipe 39 to the tub 31.

A vent pipe tub connector 39*a* is connected to an upper side of the tub 31, wherein the vent pipe tub connector 39*a* is formed so as to penetrate a lower surface of the cabinet 10, and further an end of the vent pipe 39 is connected to the tub 31 in a state of being in communication with the vent pipe tub connector 39*a*.

At this time, it is preferable that the second internal passage 990 is connected to a side of the vent pipe 39 which is placed adjacently to the vent pipe tub connector 39*a*. In other words, because the vent pipe tub connector 39*a* is disposed to vertically penetrate thereto and simultaneously an end of the vent pipe tub connector 39*a* is also vertically in communication therewith, there can be an advantage that detergent supplied in the vent pipe 39 through the second internal passage 990 directly descend along a vertical direction to the vent pipe 39 communicated therewith. If the vent pipe tub connector 39*a* is not disposed vertically, there may be a problem that detergent would leak to outside from the cabinet 10 due to a slanted vent pipe 39.

As a result of the forgoing, a passage connection structure according to the first exemplary implementation of the present disclosure may have an advantage of supplying detergent into the tub 31 with making use of a drawer as conventional manner when an automatic detergent supply device is not in use. There may also be an advantage of supplying detergent contained in the automatic detergent supply device to the tub 31 with making use of the vent pipe 39 installed at the main washing machine in a state that the vent pipe 39 connected to the tub 31 is contacted to the second internal passage 990 when the automatic detergent supply device is in use.

Figure 22:
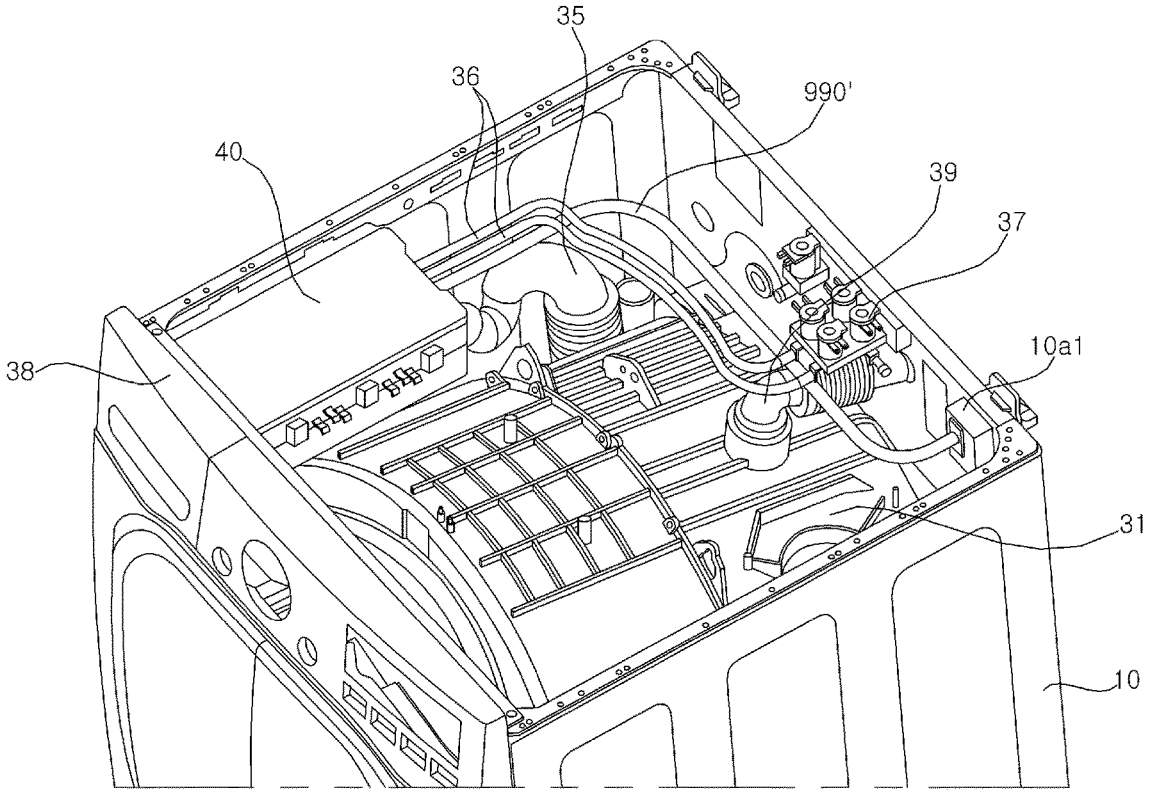
FIG. 22 is a schematic view showing a second internal passage of the washing machine according to the second implementation of the present disclosure.
Figure 23:
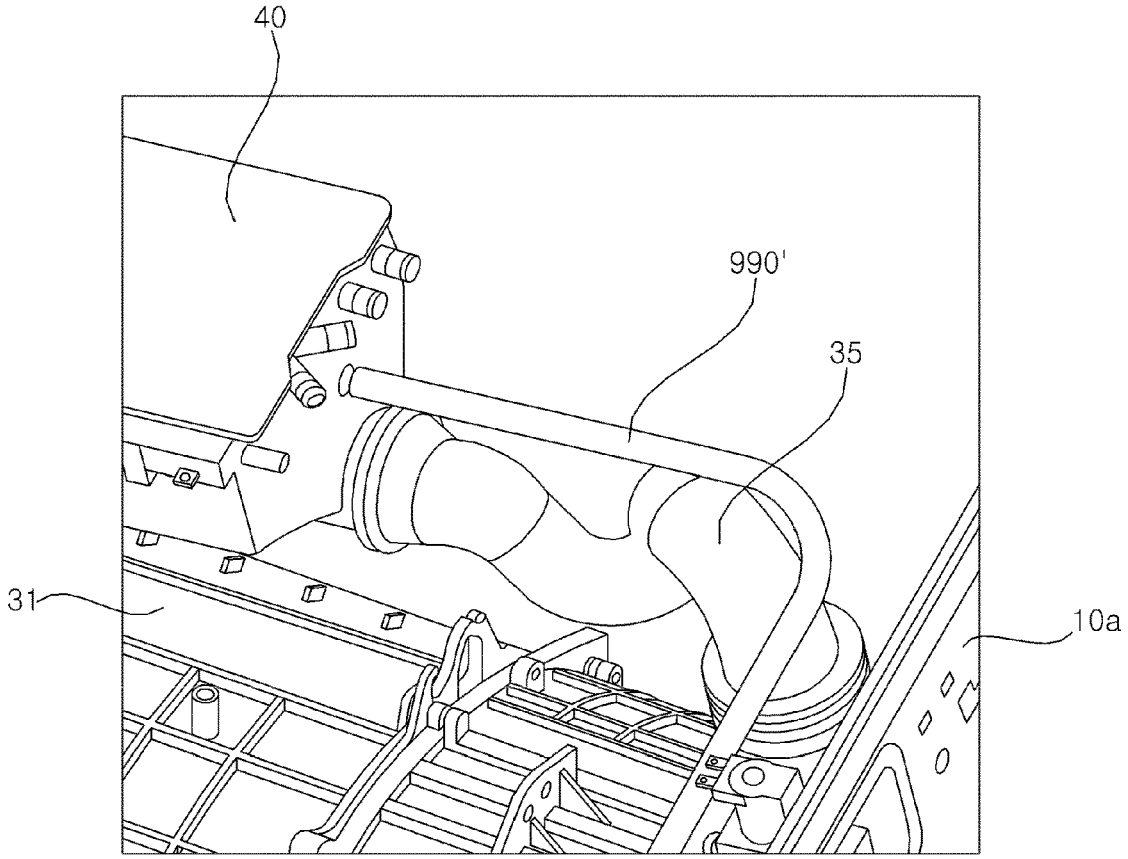
FIG. 23 is a schematic view showing a state that the second internal passage of FIG. 22 is installed at the drawer.
Figure 24:
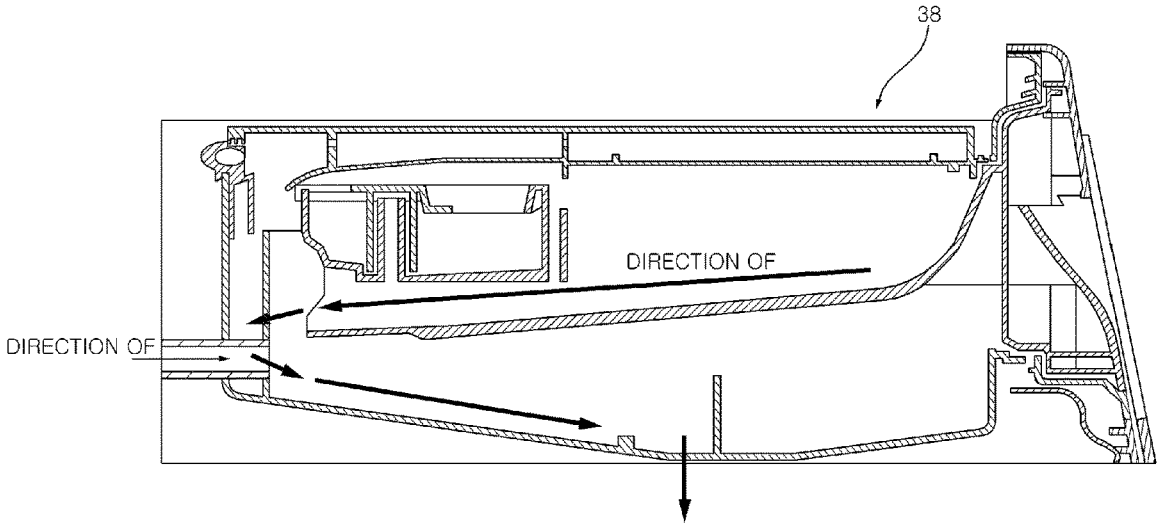
FIG. 24 is a cross-sectional view showing a state that the second internal passage of FIG. 22 is installed at the drawer.

Hereinafter, referring to FIG. 22 through FIG. 24, a second internal passage 990' according to the second exemplary implementation of the present disclosure will be described.

According to the second exemplary implementation of the present disclosure, an end of the second internal passage 990' is connected to the cabinet connector 950, and the other end thereof is connected to the drawer 38, so that detergent supplied through the detergent supply device 100 is supplied sequentially via the second internal passage 990' and the drawer 38 to the tub 31.

At this time, detergent supplied to the drawer 38 is supplied along an inner wall of the drawer 38 to the drawer housing 40 containing the drawer 38, and detergent supplied to the drawer housing 40 is supplied via the first passage 35 connecting the tub 31 and the drawer housing 40 into the tub 31.

The water supply passage 36 is connected to the drawer 38, wherein the water supply passage is mounted to the first water supply valve 37, and water supplied through the water supply passage 36 is supplied sequentially via drawer housing 40 and the first passage 35 with detergent supplied through the second internal passage 990' into the tub 31.

The second internal passage 990' is mounted to the drawer 38 at a lower height than a position where water is supplied through the water supply passage 36. And, detergent supplied through the second internal passage 990' is supplied along an inner wall of the drawer 38 with flowing water, wherein the water is descended by gravity from an upper side of detergent, thereby water is supplied into the tub 31 through the first passage 35 placed at a lowest of the drawer 38.

As a result of the forgoing, a passage connection structure according to the second exemplary implementation of the present disclosure may have an advantage of supplying detergent into the tub 31 with making use of a drawer as conventional manner when an automatic detergent supply device is not in use. There may also be an advantage of supplying detergent contained in the automatic detergent supply device to the tub 31 with making use of a detergent supply system of the drawer 38 installed at the main washing machine in a state that the drawer 38 connected to the tub 31 is contacted to the second internal passage 990' when the automatic detergent supply device is in use.

Figure 25:
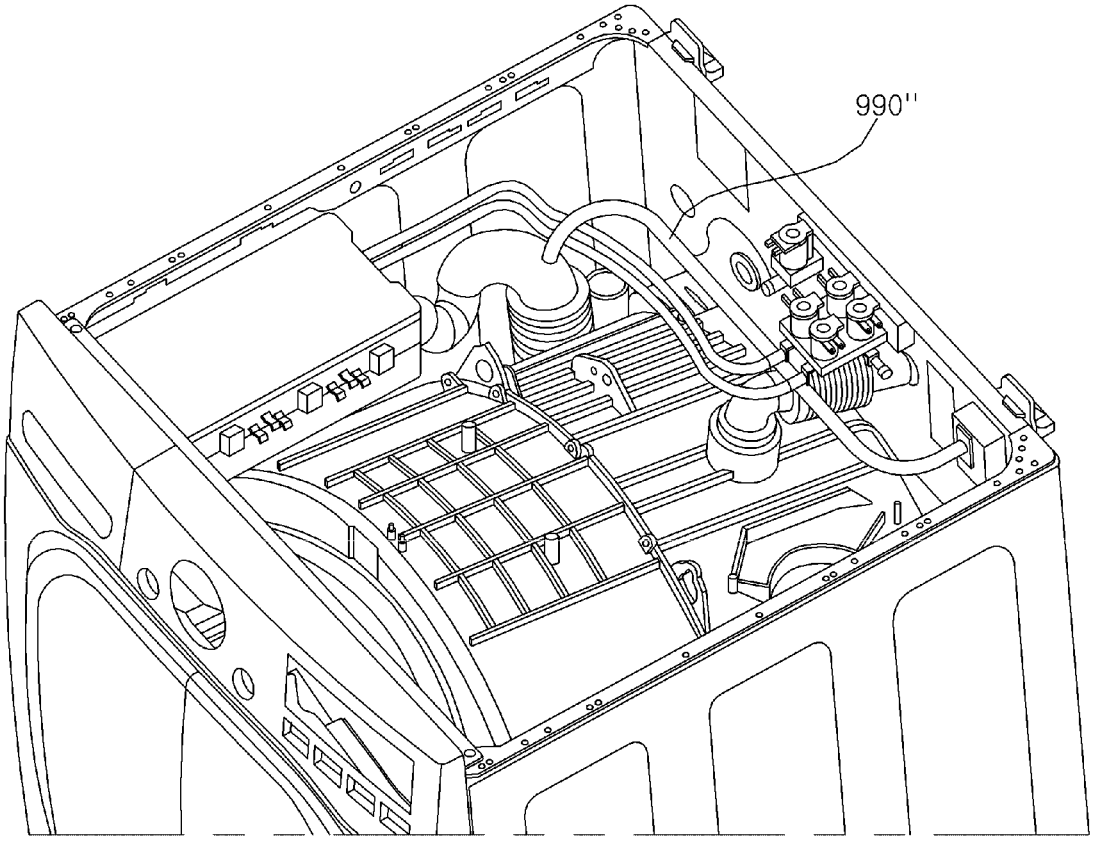
FIG. 25 is a schematic view showing the second internal passage of a washing machine according to the third implementation of the present disclosure.

Hereinafter, referring to FIG. 25, a second internal passage 990" according to the third exemplary implementation of the present disclosure will be described.

According to the third exemplary implementation of the present disclosure, an end of the second internal passage 990" is connected to the cabinet connector 950, and the other end thereof is connected to the first passage 35, so that detergent supplied through the detergent supply device 100 is supplied sequentially via the second internal passage 990" and the first passage 35 to the tub 31.

As a result of the foregoing, according to the third exemplary implementation of the present disclosure, a passage connection structure according to the third exemplary implementation of the present disclosure may have an advantage of supplying detergent into the tub 31 with making use of a drawer as conventional manner when an automatic detergent supply device is not in use. There may also be an advantage of supplying detergent contained in the automatic detergent supply device to the tub 31 with making use of the first passage 35 installed at the main washing machine in a state that the vent pipe 39 connected to the tub 31 is contacted to the second internal passage 990" when the automatic detergent supply device is in use.

Figure 26:
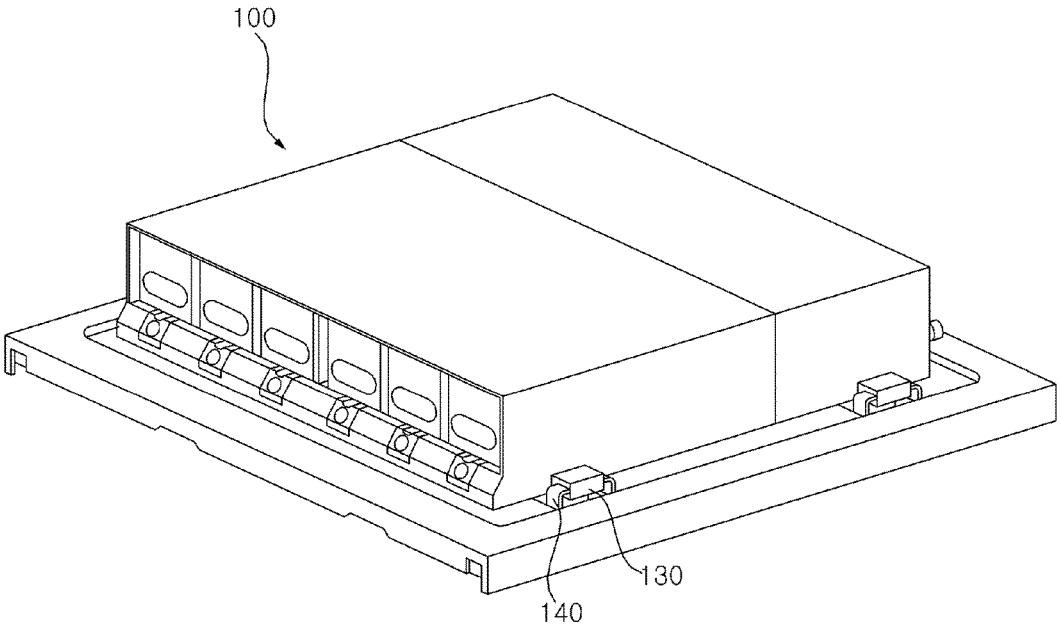
FIG. 26 is a schematic view showing a state that the cabinet of the washing machine and the detergent supply device according to an exemplary implementation of the present disclosure.
Figure 27:
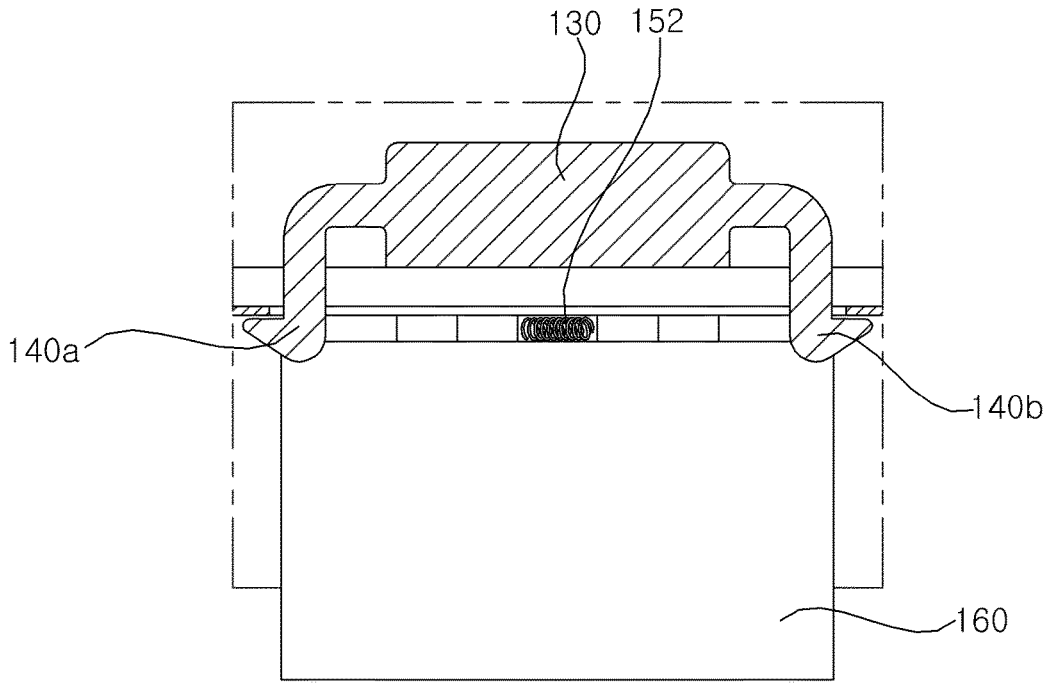
FIG. 27 is a cross-sectional view showing a hook shown in FIG. 26.
Figure 28:
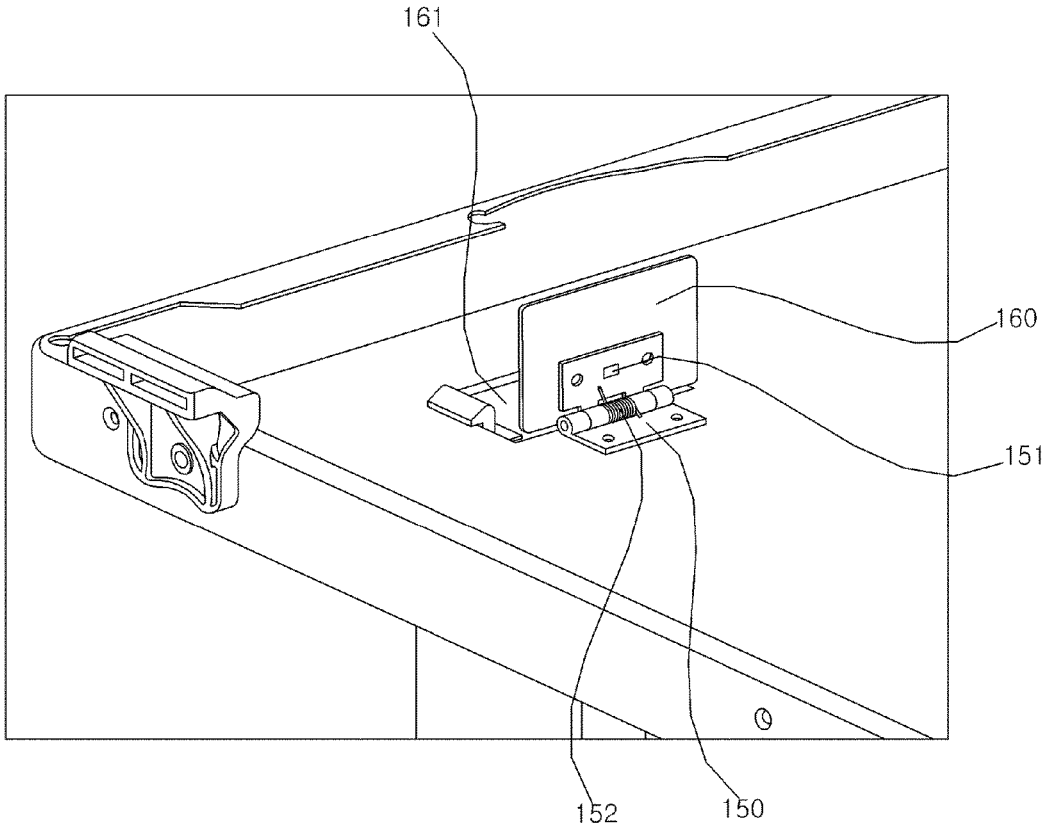
FIG. 28 is a rear view showing the cabinet employing the hook shown in FIG. 26.

Hereinafter, referring to FIG. 26 through FIG. 28, a hook 140 and parts related therewith according to an exemplary implementation of the present disclosure will be described.

In order to fixedly install the detergent supply device 100 on an upper surface of the cabinet 10, it is required to employ an attachment means between the detergent supply device 100 and the cabinet 10. According to an exemplary implementation of the present disclosure, there is provided with a plurality of cover protrusions 130 formed at a side of the cover 120 and a hook 140 installed at the both lateral surfaces of the cover protrusion 130, so the hook 140 is inserted to an inner side of the cabinet 10 through a hook opening 161 disposed at an upper surface of the cabinet 10, and then the hook 140 is fixedly engaged with the inside of the cabinet 10 at the upper surface thereof.

According to an exemplary implementation of the present disclosure, there is provided two cover protrusions 130 installed respectively per one side of the both sides of the cover 120, and further there is provided hooks 140*a*, 140*b* disposed at the both ends of the cover protrusion 130, so the hooks 140*a*, 140*b* are engaged with the both sides of the hook opening 161. But the number of the cover protrusions and the hooks 140 is not limited to these examples.

A hook door 160 for opening or closing an opening is disposed at the hook opening 161. A hinge 150 connecting the hook door 160 and an upper surface of the cabinet 10 is installed on a side of the hook door 160.

A torsion spring 152 is disposed at the hinge 150. In a case of not installing the detergent supply device 100 on an upper surface of the cabinet 10, the hook door 160 functions to close the hook opening 161 with an elastic force of the torsion spring 152. But in a case of employing the detergent supply device 100 installed on an upper surface of the cabinet 10, the hook 140 of the detergent supply device 100 is engaged with a side of the hook opening 161 while the hook 140 of the detergent supply device 100 is continuously moved downwardly in a state of having stronger force than an elastic force of the torsion spring 152, the hook opening 161 cannot help being kept opened. Here, a sensor 151 installed at the hinge 150 can detect whether the hook door is opened or closed so as to determine that the detergent supply device 100 is mounted or not.

Figure 29:
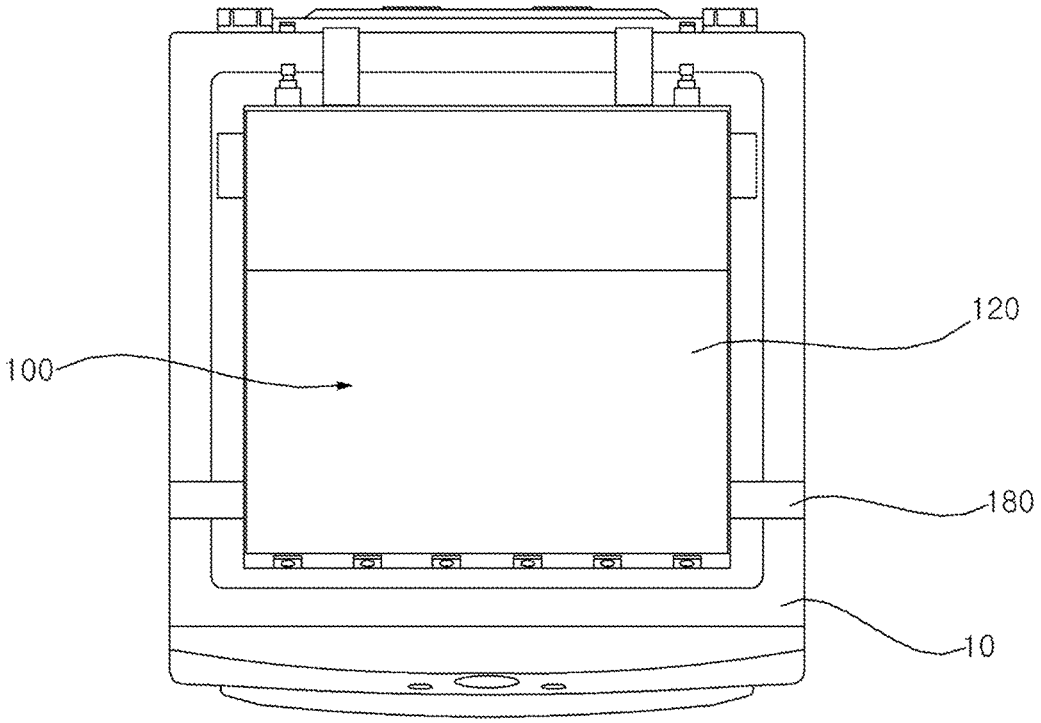
FIG. 29 is a schematic view showing a state that a detergent supply device of a washing machine and a cabinet are mounted according to one implementation of the present disclosure.
Figure 30:
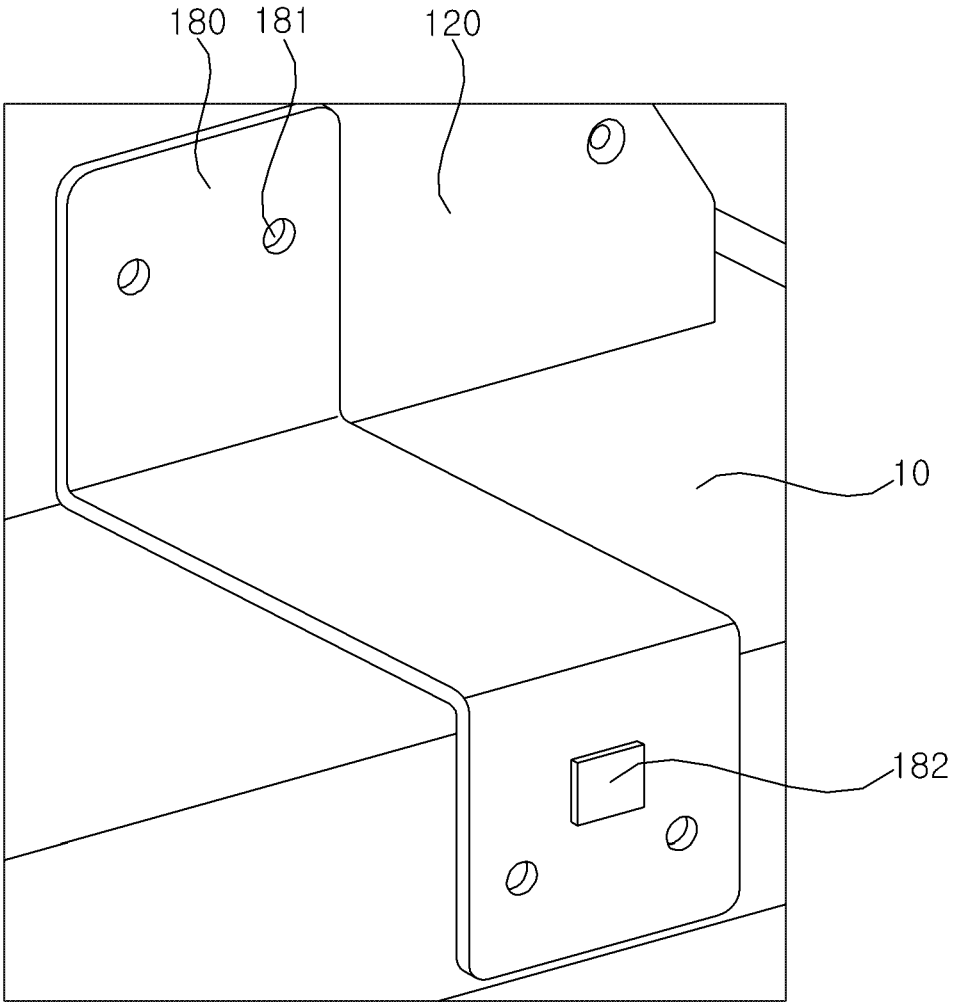
FIG. 30 is an enlarged view showing an engaging guide shown in FIG. 29.

Hereinafter, referring to FIG. 29 and FIG. 30, a mount guide 180 according to the other exemplary implementation of the present disclosure will be described.

According to the other exemplary implementation of the present disclosure, there may be provided with a mount guide 180 installed at a lateral surface and a rear surface of the cover 120 so that the detergent supply device 100 is fixedly installed on an upper surface of the cabinet 10.

The mount guide 180 is contacted to the cover 120 of the detergent supply device 100, and simultaneously is contacted to an upper surface and a lateral surface of the cabinet 10. A mount hole 181 is formed at a portion which the cover 120 and a lateral surface of the cabinet 10 are contacted so that the cover 120 and a lateral surface of the cabinet 10 may be secured by bolting or something. There may be provided with a sensor disposed at the mount guide 180 which is disposed at a portion which a lateral surface of the cabinet 10 is contacted, so it is possible to determine that the detergent supply device 100 is mounted or not.

According to another implementation of the present disclosure, two mount guides 180 are disposed at a rear surface of the cover 120, and two mount guides are disposed at a lateral surface of the cover 120. But the number of the mount guides is not thusly limited.

Figure 31:
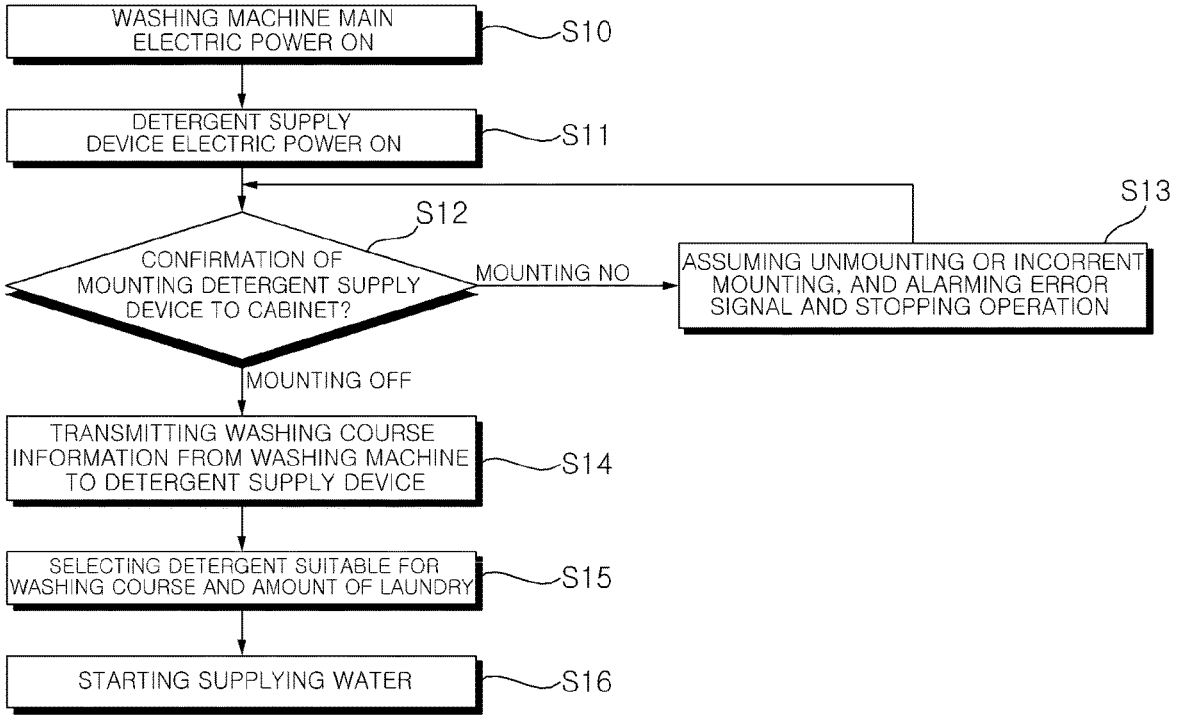
FIG. 31 is a flow chart showing an example method for determining whether the detergent supply device and the cabinet are connected.

Hereinafter, referring to FIG. 31, an algorithm for determining whether the detergent supply device 100 and the cabinet 10 are correctly connected will be described.

In order to supply detergent via the detergent supply device to the main washing machine accommodated in the cabinet, it is required to determine whether the main washing machine and the detergent supply device are correctly connected, and further required to transmit an information obtained through the main washing machine to the detergent supply device, and then it is required to be supplied appropriate detergent corresponding to a laundry.

If a state of connection therebetween is not confirmed, the detergent in the detergent supply device cannot be supplied properly into the tub of the cabinet, as well as detergent in the detergent supply device may leak and be deteriorated.

Hereinafter, determining whether a detergent supply device is correctly connected and an algorithm about transmitting information related therewith will be described.

First of all, a main washing machine accommodated in the cabinet 10 is turned on (S10). The detergent supply device 100 is turned on (S11). After that, it is determined whether the cabinet 10 and the detergent supply device 100 are correctly connected (S11). Here, it may be possible to determine whether the cabinet 10 and the detergent supply device 100 are correctly connected by making use of a sensor 151 installed on the hinge 150 according to an exemplary implementation of the present disclosure or a sensor 182 installed at the mount guide 180 according to the other exemplary implementation of the present disclosure. Further, there may be provided with a sensor installed on the first and second heads 920, 930 of a passage connector, so that it is determined whether a passage is correctly connected.

According to a result of the foregoing, if it is determined that the detergent supply device 100 and the cabinet 10 is not properly connected, it may be assumed that the detergent supply device 100 is not mounted or incorrectly mounted. At this time, it is possible to sound an alarm for indicating an error and to stop washing operation.

According to a result of the foregoing, if it is determined that the detergent supply device 100 and the cabinet 10 are properly connected, the main washing machine may transmit an information about washing procedure to the detergent supply device (S14). An information about amount of laundry is transmitted to the detergent supply device (S15). The detergent supply device 100 may select an appropriate detergent corresponding to the washing procedure and the amount of laundry (S16). And then, the water supply valve 830 allows water to be supplied and detergent contained in a cartridge 200 may be supplied through the passage connector 900 to the tub 31.

Although the implementations of the present disclosure are described above with reference to the accompanying drawings, the present disclosure is not limited to the above implementations, and may be manufactured in various forms, and in the art to which the present disclosure belongs, those skilled in the art will appreciate that the present disclosure may be embodied in other specific forms without changing the technical spirit or essential features of the present disclosure. Therefore, it should be understood that the implementations described above are exemplary in all respects and not restrictive.

What is claimed is:

1. A washing machine comprising:

a cabinet;

a tub disposed in the cabinet and configured to receive water;

a drum rotatably disposed in the tub and configured to receive laundry;

a drawer configured to be inserted into and withdrawn out of the cabinet, the drawer being configured to contain detergent;

a first passage connecting the drawer and the tub;

a detergent supply device disposed on the cabinet, the detergent supply device being configured to contain detergent; and a second passage connecting the detergent supply device to the tub or the drawer, the second passage being configured to guide the detergent contained in the detergent supply device to the tub or the drawer, wherein the second passage comprises:

an external passage that is disposed outside the cabinet and that is configured to connect the detergent supply device to a rear surface of the cabinet, and an internal passage that is disposed inside the cabinet and that is configured to connect the external passage to the drawer or the tub.

2. The washing machine of claim 1, further comprising a vent pipe connecting an inside of the tub to an outside of the cabinet, wherein the internal passage is connected to the vent pipe such that the detergent supplied through the internal passage is supplied to the tub via the vent pipe.

3. The washing machine of claim 2, wherein the vent pipe is connected to an upper side of the tub and the rear surface of the cabinet.

4. The washing machine of claim 3, further comprising a vent pipe tub connector disposed at an upper side of the tub, wherein the vent pipe tub connector is disposed perpendicular to a lower surface of the cabinet, and wherein the vent pipe is connected to the vent pipe tub connector.

5. The washing machine of claim 1, wherein the internal passage is connected to the drawer such that the detergent guided through the internal passage is supplied to the tub via the drawer.

6. The washing machine of claim 5, further comprising a drawer housing that accommodates the drawer at a lower side thereof, wherein detergent supplied into the drawer is supplied to the drawer housing.

7. The washing machine of claim 6, wherein the drawer housing is connected to the first passage such that the detergent supplied to the drawer housing is supplied via the first passage to the tub.

8. The washing machine of claim 7, further comprising a water supply passage that is connected to the drawer, wherein water is supplied to the tub with detergent through the water supply passage via the first passage.

9. The washing machine of claim 1, wherein the second passage is connected to the first passage such that detergent guided through the second passage is supplied to the tub via the first passage.

10. The washing machine of claim 1, the washing machine comprising a cabinet connector disposed at the rear surface of the cabinet, the cabinet connector connecting the external passage to the internal passage.

11. The washing machine of claim 10, wherein the external passage comprises:

a connecting hose;

a first head disposed at an end of the connecting hose, the first head being connected to the detergent supply device; and a second head disposed at the other end of the connecting hose, wherein the second head is connected to the cabinet connector.

12. The washing machine of claim 1, further comprising a first water supply valve that is configured to control supplying of water to the drawer.

13. The washing machine of claim 12, further comprising a second water supply valve that is configured to control supplying of water to the detergent supply device.

14. The washing machine of claim 1, wherein the second passage is disposed between the detergent supply device and the tub, the second passage being configured to guide the detergent contained in the detergent supply device to the tub.

15. The washing machine of claim 1, wherein the second passage is disposed between the detergent supply device and the drawer, the second passage being configured to guide the detergent contained in the detergent supply device to the drawer.

* * * * *